US008076046B2

(12) United States Patent
Kurauchi et al.

(10) Patent No.: US 8,076,046 B2
(45) Date of Patent: Dec. 13, 2011

(54) ELECTROPHOTOGRAPHIC PHOTORECEPTOR AND IMAGE FORMATION DEVICE PROVIDED WITH THE SAME

(75) Inventors: Takahiro Kurauchi, Neyagawa (JP); Kotaro Fukushima, Kawanishi (JP); Akihiro Kondoh, Nara (JP)

(73) Assignee: Sharp Kabushiki Kaisha, Osaka (JP)

( * ) Notice: Subject to any disclaimer, the term of this patent is extended or adjusted under 35 U.S.C. 154(b) by 401 days.

(21) Appl. No.: 12/417,196

(22) Filed: Apr. 2, 2009

(65) Prior Publication Data

US 2009/0253057 A1 Oct. 8, 2009

(30) Foreign Application Priority Data

Apr. 8, 2008 (JP) ..... 2008-100410

(51) Int. Cl.
*G03G 15/02* (2006.01)
*G03G 15/00* (2006.01)

(52) U.S. Cl. ..... 430/58.05; 430/58.35; 430/58.65; 430/58.75; 430/66; 399/159

(58) Field of Classification Search ..... 430/58.05, 430/58.35, 58.65, 58.75, 66; 399/159
See application file for complete search history.

(56) References Cited

U.S. PATENT DOCUMENTS

| | | | |
|---|---|---|---|
| 4,606,934 A | 8/1986 | Lee et al. | |
| 7,381,511 B2 | 6/2008 | Ikegami et al. | |
| 2005/0008957 A1* | 1/2005 | Ikegami et al. | 430/56 |

FOREIGN PATENT DOCUMENTS

| | | |
|---|---|---|
| JP | 57-030846 | 2/1982 |
| JP | 61-72256 | 4/1986 |
| JP | 64-023259 | 1/1989 |
| JP | 01-172970 | 7/1989 |
| JP | 01-205171 | 8/1989 |
| JP | 2004-233955 | 8/2004 |

* cited by examiner

*Primary Examiner* — Thorl Chea
(74) *Attorney, Agent, or Firm* — Nixon & Vanderhye, P.C.

(57) ABSTRACT

An electrophotographic photoreceptor comprising a conductive support and a photosensitive layer obtained by laminating at least a charge generation layer and a charge transport layer containing a charge transport material in this order on the conductive support, the photosensitive layer being provided with a surface protective layer on the surface thereof, wherein the protective layer contains at least filler particles which exhibit a dispersed state defined by Rf given by the following equations (1) and (2):

$$Rf=(df\times b^3)/(dm\times a^3) \quad (1)$$

$$1.0\times10^{-3}\leqq Rf\leqq 2.5\times10^{-2} \quad (2)$$

and a diamine compound represented by the following formula (I):

(I)

10 Claims, 2 Drawing Sheets

ELECTROPHOTOGRAPHIC PHOTORECEPTOR AND IMAGE FORMATION DEVICE PROVIDED WITH THE SAME

CROSS-REFERENCE TO RELATED APPLICATION

This application is related to Japanese Patent Application No. 2008-100410 filed on 8 Apr. 2008, whose priority is claimed under 35 USC §119, and the disclosure of which is incorporated by reference in its entirety.

BACKGROUND OF THE INVENTION

1. Field of the Invention

The present invention relates to an electro-photographic photoreceptor used for image formation in an electrophotographic system and to an image formation device provided with the photoreceptor.

2. Description of Related Art

An electrophotographic system image formation device (hereinafter also referred to as "electrophotographic device") using electrophotographic technologies to form an image is used for many copying machines, printers, and facsimile devices.

In an electrophotographic device, an image is formed through the following electrophotographic processes.

First, the photoreceptor layer of the electrophotographic photoreceptor (hereinafter also referred to as "photoreceptor") mounted on the device is made to charge uniformly to a given potential by a charger and then exposed to light such as laser light applied corresponding to image information from the exposure device to form an electrostatic latent image.

A developer is supplied to the formed electrostatic latent image from the developing device to stick colored microparticles called a toner which is a component of the developer to a surface of the photoreceptor to develop the electrostatic latent image, thereby visualizing the latent image as a toner image.

The formed toner image is transferred to a transfer material such as recording paper from a surface of the photoreceptor by the transfer device and then fixed by the fixing device to form a desired image.

In the transfer action of the transfer device, the toner on a surface of the photoreceptor is not fully transferred to the transfer material but a part of the toner is left on the surface of the photoreceptor. Further, there is the case where a paper powder of recording paper remains stuck to the surface of the photoreceptor.

Foreign substances such as these residual toners and stuck paper powder adversely affect on the quality of a formed image and are therefore removed by a cleaning device.

With the recent development of cleaner-less technologies, a developing means into which a cleaning function is incorporated without independent cleaning devices, that is, a system having both developing and cleaning functions is used to recover residual toners and to remove foreign substances such as a stuck paper powder.

After a surface of the photoreceptor is cleaned, a charge of a surface of the photoreceptor is removed by a charge removing device to make the electrostatic latent image disappear.

The photoreceptor used in this electrophotographic process is constituted by laminating a photoreceptor layer containing a photoconductive material on a conductive substrate.

The photoreceptor material is largely divided into an inorganic photoconductive material and an organic photoconductive material.

The inorganic photoconductive material has recently come to be scarcely used as a photosensitive material because of its toxicity. However, a non-pollutant amorphous silicon type (a-Si) photoreceptor is still being developed.

Though the a-Si photoreceptor has merits such as high sensitivity and high durability, it has a drawback that it is difficult to form the photosensitive layer uniformly, so that image defects are easily caused. Also, the a-Si photoreceptor has drawbacks including low productivity and high production cost.

Since the inorganic type photoreceptors have many drawbacks as mentioned above, the development of photoconductive materials used to form the photoreceptor are forwarded and many organic type photoconductive materials, that is, organic photoconductors (abbreviation: OPC) have come to be largely used.

Though electrophotographic photoreceptors using organic type photoconductor materials (hereinafter referred to also as an "organic photoreceptor"), have some problems concerning sensitivity, durability and stability to environments, they have more advantages than inorganic photoreceptors in the points of toxicity, production cost and degree of freedom in design of materials.

The organic photoreceptor also has the advantage that the photosensitive layer constituting the photoreceptor can be formed by known easy and economic methods represented by a dip coating method.

The organic photoreceptor has many advantages as mentioned above, and therefore has gradually come to occupy the mainstream of the photoreceptor.

Also, along with recent studies and development, the sensitivity and durability of the organic photoreceptor have been improved and therefore, the organic photoreceptor has come to be used except for special cases.

In particular, the performance of the organic type photoreceptor has been significantly improved with the development of the function separation type photoreceptor containing different materials assigned to have a charge generation function and charge transportation function separately.

Specifically, the function separation type photoreceptor has a further advantage that the material constituting the photosensitive layer can be selected from a wide range of materials and therefore, a photoreceptor having desired characteristics can be produced relatively easily, besides the above advantages that the organic type photoreceptor has.

In electrophotographic devices, the above charge, exposure, developing, transfer, cleaning and charge-removal actions are practically exerted on the photoreceptor repeatedly under various environments. Therefore, it is demanded of the photoreceptor to have high environmental stability, electrical stability and durability (printing durability) against mechanical external force besides high sensitivity and high responsibility to light.

Specifically, the photoreceptor is desired to have high printing durability so that the surface layer thereof is resistant to abrasion caused by the sliding contact with the cleaning member.

To take appropriate measures to improve the printing durability, an attempt is made to add filler particles in the charge transport layer of a laminate type photoreceptor to thereby improve the printing durability. However, there is the possibility of image defects caused by nonuniformity of a layer in the vicinity of the boundary between the charge generation layer and the charge transport layer which is considered to be due to the interaction between the filler particles and the charge generation layer, showing that the effect of the attempt is not said to be sufficient.

Moreover, when a filler is added to the charge transport layer, this gives rise to the production of a trap with a size extending to tens of micrometers over the entire charge transport layer between filler particles and a polymer bulk (binder resin) contained in the photoreceptor, which remarkably increases the risk of a rise in the residual potential of the exposure part.

In light of this, technologies in which a surface protective layer on the outermost layer of a photoreceptor (see, for example, Japanese Patent Application Laid-Open No, 57-30846), technology in which lubricity is provided to the surface protective layer (see, for example, JP-A No. 64-23259), technologies in which the surface protective layer is hardened (see, for example, JP-A No. 61-72256) and technologies in which the surface protective layer is made to contain filter particles (see, for example, JP-A No. 1-172970).

Among the above technologies, the technologies in which the surface protective layer is made to contain filler particles involves such a new factor as the control of the dispersibility of particles, which has an effect on characteristics of the photoreceptor.

Specifically, the characteristics of the photoreceptor are not defined only by simple addition of fillers. It is reported that the printing durability of the photoreceptor is improved by addition of a filler in an amount of about 0.1 to about 10% by weight based on the total solid of the surface protective layer (see, for example, JP-A No. 1-205171).

However, it is estimated with ease that a difference in the dispersed state of filler particles brings about a difference in the image characteristics/electric properties/printing durability of the photoreceptor as a photoreceptor drum.

Also, when the dielectric constant of the surface protective layer is non-uniform, there is the case where this causes a thick image to be formed at the edge part when a black solid image is output and a toner is scattered. It is found from this fact that the dispersion state of filler particles inside of the surface protective layer has a large influence on the characteristics of the photoreceptor.

Moreover, the addition of fillers with the intention of improving the printing durability gives rise to the problem described below. The problem is that the photoreceptor is easily affected by ozone emitted from a corona discharge device and oxidizing gases such as nitrogen oxides. As a result, the photoreceptor gives rise to a reduction in charge potential, a rise in residual potential and a reduction in surface resistance, resulting in a deterioration in resolution, a significant deterioration in output image and short life of the photoreceptor.

For these phenomena, there are proposals concerning measures taken to evade a direct influence of gas on the photoreceptor by exhausting and displacing the gas around the corona discharge device and measures taken to prevent the deterioration of the photoreceptor by adding an antioxidant and a stabilizer to the surface protective layer containing filler particles.

However, when an antioxidant and a stabilizer are added in a small amount to the surface protective layer containing filler particles, this is sometimes causes of a rise in residual potential from the first and abrasion of the film.

When an antioxidant and a stabilizer are added in such an amount as to stand to repeated use for a long period of time, on the other hand, this causes a rise in residual potential from the first and an increase in the abrasion of the film.

In other words, the above prior technologies have not succeeded in developing an excellent photoreceptor having both printing durability and ozone resistance at the same time yet. Also, such practically unfavorable defects that the electrophotographic characteristics such as sensitivity and residual potential are impaired when an antioxidant is added as mentioned above still remain at present.

Therefore, useful proposals are expected as to a novel material which is improved in printing durability and ozone resistance and is entirely free from defects in electrophotographic characteristics.

SUMMARY OF THE INVENTION

Accordingly, it is an object of the present invention to provide an electrophotographic photoreceptor which is superior in mechanical/electrical durability, does not generate abnormal images such as a blurred image and can stably output an image even if it is used repeatedly for a long period of time, and to provide an image formation device provided with the electrophotographic photoreceptor.

The inventors of the present invention have made earnest studies as to improvements in the printing durability and ozone resistance of the photoreceptor provided with a laminate type photoreceptor, and as a result, found that a photoreceptor which is improved in printing durability and is superior in ozone resistance by formulating filler particles which exhibit a specified dispersed state and a specified diamine compound in the surface protective layer formed on the upper part of the charge transport layer, to complete the present invention.

Herein, in order to achieve the above effect, there is an idea of formulating the filler particles and a diamine compound so as to form one layer in the charge transport layer. This method is considered to be superior from the viewpoint of reducing production costs because all functions are provided in one layer.

However, because the charge transport layer constitutes the outermost surface layer in this case, it is not possible to perfectly prevent gases such as ozone from entering into the charge transport layer and therefore, the deterioration of the charge transport agent contained in the charge transport layer cannot be prevented satisfactorily.

According to the present invention, there is provided an electrophotographic photoreceptor comprising a conductive support and a photosensitive layer obtained by laminating at least a charge generation layer and a charge transport layer containing a charge transport material in this order on the conductive support, the photosensitive layer being provided with a surface protective layer on the surface thereof, wherein the protective layer contains at least filler particles which exhibit a dispersed state defined by Rf given by the following equations (1) and (2):

$$Rf=(df\times b^3)/(dm\times a^3) \quad (1)$$

$$1.0\times10^{-3}\leqq Rf\leqq 2.5\times10^{-2} \quad (2)$$

wherein a is an average distance (nm) between fillers, b is an average particle diameter (nm) of fillers, df is the a density ($g/cm^3$) of filler particles and dm is an average density ($g/cm^3$) of a solid in the surface protective layer, and a diamine compound represented by the following formula (I):

(I)

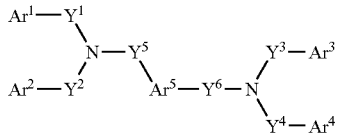

wherein $Ar^1$, $Ar^2$, $Ar^3$ and $Ar^4$, which may be the same or different, each represent an aryl group, cycloalkyl group or monovalent heterocyclic residue which may have a substituent; $Ar^5$ represents an arylene group or a divalent heterocyclic residue; and $Y^1$, $Y^2$, $Y^3$, $Y^4$, $Y^5$ and $Y^6$, which may be the same or different, each represent a chain alkylene group which may have a substituent.

According to the present invention, there is also provided an image formation device comprising a photoreceptor, a charging means that charges the photoreceptor, an exposure means that exposes the above charged photoreceptor to light to form an electrostatic latent image, a developing means that develops the electrostatic latent image formed by the exposure and a transfer means that transfers the above electrostatic latent image to a transfer material.

The present invention can provide a highly durable electrophotographic photoreceptor which is superior in mechanical/electrical durability, does not generate abnormal images such as a blurred image and can stably output an image even if it is used repeatedly for a long period of time, and to provide an image formation device provided with the electrophotographic photoreceptor.

Specifically, the photoreceptor of the present invention is made to contain filler particles in the surface protective layer thereof to improve printing durability, though a blurred image is easily formed by the addition of the filler particles: however, the present invention can evade this image blurring by formulating a specified diamine compound having gas resistance.

Accordingly, in the image formation device of the present invention, a high-quality image free from image defects can be stably formed for a long period of time under various environments.

DETAILED DESCRIPTION OF THE PREFERRED EMBODIMENTS

Figure 1:
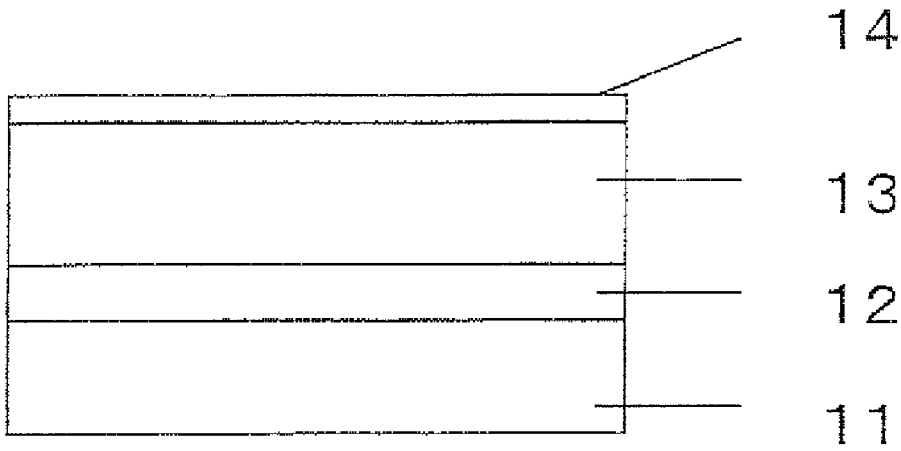
FIG. 1 is a typical sectional view showing the structure of an essential part of a laminate type photoreceptor according to the present invention.

A photoreceptor according to the present invention is characterized by the feature that at least a charge generation layer containing a charge generation material and a charge transport layer containing a charge transport material are laminated in this order on a conductive support made of a conductive material to form a photosensitive layer, the photosensitive layer being provided with a surface protective layer on the upper part thereof, wherein the protective layer contains at least filler particles which exhibit a dispersed state given by the above equation (1) and defined by the above equation (2) and a diamine compound represented by the above formula (I).

Among the diamine compounds represented by the formula (I), diamine compounds represented by the above formula (I) in which $Y^1$, $Y^2$, $Y^3$, $Y^4$, $Y^5$ and $Y^6$ are respectively a chain alkylene group, that is, diamine compounds represented by the following sub-formula (II) are preferable from the viewpoint of the chemical stability required for a chemical material such as resistances to decomposition and denaturing, easy availability of raw materials, easy production, high yield and production costs:

(II)

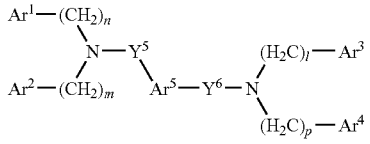

wherein $Ar^1$, $Ar^2$, $Ar^3$, $Ar^4$, $Ar^5$, $Y^5$ and $Y^6$ each represent the same meanings as those in the above formula (I); and l, m, n and p, which may be the same or different, each denote an integer from 1 to 3.

Moreover, the diamine compounds represented by the above formula (U) in which $Y^1$, $Y^2$, $Y^3$, $Y^4$, $Y^5$ and $Y^6$ are respectively a chain methylene group, that is, diamine compounds represented by the following sub-formula (III) are more preferable:

(III)

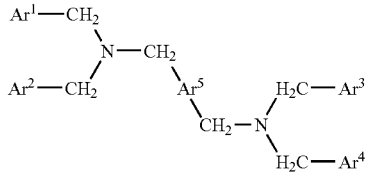

wherein $Ar^1$, $Ar^2$, $Ar^3$, $Ar^4$ and $Ar^5$ each represent the same meanings as those in the above formula (I).

Each substituent in the formula (I), sub-formula (II) and sub-formula (III) will be explained below.

Examples of the aryl group of $Ar^1$, $Ar^2$, $Ar^3$ or $Ar^4$ which may have a substituent include aryl groups which may be substituted with an alkyl group having 1 to 4 carbon atoms, an alkoxy group having 1 to 4 carbon atoms, a dialkylamino group having 2 to 6 carbon atoms or a halogen atoms.

Specific examples of the aryl group include phenyl group, tolyl group, xylyl group, methoxyphenyl group, methylmethoxyphenyl group, t-butylphenyl group, 4-diethylaminophenyl group, 4-chlorophenyl group, 4-fluorophenyl group, naphthyl group and methoxynaphthyl group. Among these groups, phenyl group, tolyl group, methoxyphenyl group and naphthyl group are particularly preferable.

Examples of the cycloalkyl group of $Ar^1$, $Ar^2$, $Ar^3$ or $Ar^4$, which may have a substituent include cycloalkyl groups which may be substituted with an alkyl group having 1 to 4 carbon atoms.

Specific examples of the cycloalkyl group include cyclohexyl group, cyclopentyl group and 4,4-dimethylcyclohexyl group. Among these groups, cyclohexyl group is preferable.

Examples of the monovalent heterocyclic residue of $Ar^1$, $Ar^2$, $Ar^3$ or $Ar^4$ which may have a substituent include tetrahydrofuryl group and tetramethyltetrahydrofuryl group.

Examples of the monovalent heterocyclic residue include monovalent heterocyclic residues which may be substituted with an alkyl group having 1 to 4 carbon atoms.

Specific examples of the monovalent heterocyclic residue include furyl group, 4-methylfuryl group, benzofuryl group and benzothiophenyl group. Among these groups, furyl group and benzofuryl group are particularly preferable.

Examples of the arylene group of $Ar^5$, which may have a substituent include arylene groups which may be substituted with an alkyl group having 1 to 4 carbon atoms or a alkoxy group having 1 to 4 carbon atoms.

Specific examples of the arylene group include p-phenylene group, m-phenylene group, methyl-p-phenylene group, methoxy-p-phenylene group, 1,4-naphthylene group, benzoxazolene group and biphenylylene group. Among these groups, p-phenylene group, m-phenylene group, methyl-p-phenylene group, methoxy-p-phenylene group and 1,4-naphthylene group are preferable and p-phenylene group and 1,4-naphthylene group are more preferable.

Examples of the divalent heterocyclic residue of $Ar^5$, which may have a substituent include 1,4-furandiyl group, 1,4-thiophenediyl group, 2,5-benzofurandiyl group, 2,5-benzoxazoldiyl group and N-ethylcarbazole-3,6-diyl group.

Examples of the chain alkylene group of $Y^1$, $Y^2$, $Y^3$, $Y^4$, $Y^5$ or $Y^6$ which may have a substituent include alkylene groups which may be substituted with an alkyl groups having 1 to 4 carbon atoms.

Specific examples of the alkylene group include methylene group, ethylene group, trimethylene group and 2,2-dimethyltrimethylene group. Among these groups, methylene group and ethylene group are particularly preferable.

Specific examples of the diamine compound used in the present invention are shown in the following Table 1.

The substituents in the following Tables 1-1 to 1-4 are represented by the following abbreviations:

—Me—: Methylene group;

—Et—: Ethylene group;

—Tr—: Trimethylene group;

—Dm—: 2,2-dimethyltrimethylene group.

TABLE 1-1

| No | $Ar^1$ | $Ar^2$ | $Ar^3$ | $Ar^4$ |
|---|---|---|---|---|
| 1 | 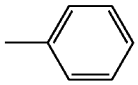 | 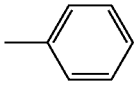 | 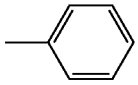 | 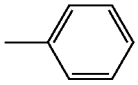 |
| 2 | 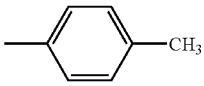 | 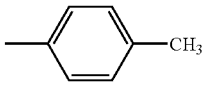 | 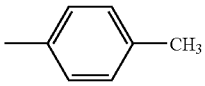 | 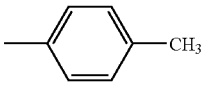 |
| 3 | 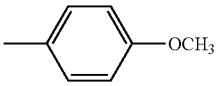 | 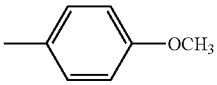 | 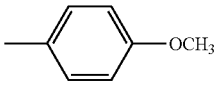 | 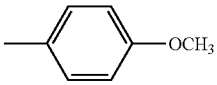 |
| 4 | 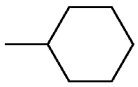 | 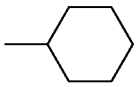 | 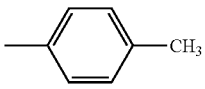 | 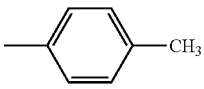 |
| 5 | 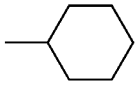 | 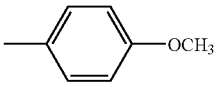 | 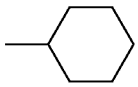 | 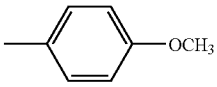 |
| 6 | 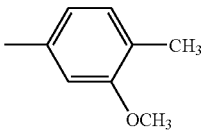 | 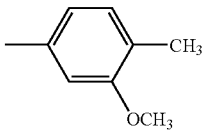 | 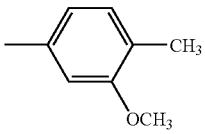 | 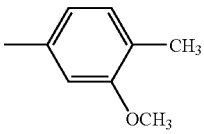 |
| 7 | 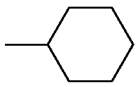 | 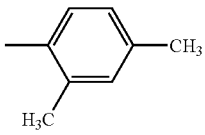 | 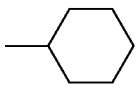 | 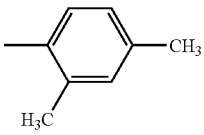 |
| 8 | 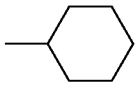 | 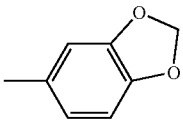 | 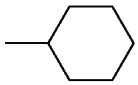 | 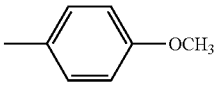 |
| 9 | 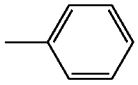 | 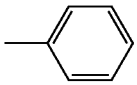 | 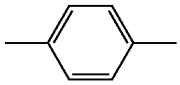 | 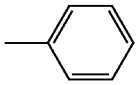 |

TABLE 1-1-continued
| No | $Ar^5$ | $Y^1$ | $Y^2$ | $Y^3$ | $Y^4$ | $Y^5$ | $Y^6$ |
|---|---|---|---|---|---|---|---|
| 1 | 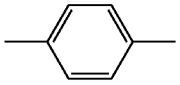 | -Me- | -Me- | -Me- | -Me- | -Me- | -Me- |
| 2 | 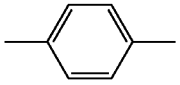 | -Me- | -Me- | -Me- | -Me- | -Me- | -Me- |
| 3 | 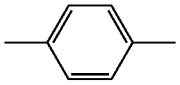 | -Me- | -Me- | -Me- | -Me- | -Me- | -Me- |
| 4 | 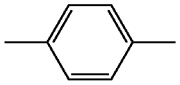 | -Me- | -Me- | -Et- | -Et- | -Me- | -Me- |
| 5 | 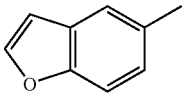 | -Me- | -Me- | -Me- | -Me- | -Me- | -Me- |
| 6 | 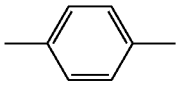 | -Et- | -Et- | -Me- | -Me- | -Me- | -Me- |
| 7 | 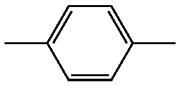 | -Me- | -Me- | -Me- | -Me- | -Me- | -Me- |
| 8 | 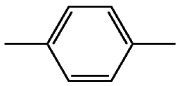 | -Me- | -Me- | -Me- | -Me- | -Me- | -Me- |
| 9 | 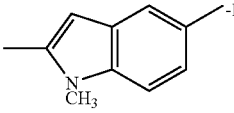 | -Me- | -Me- | -Me- | -Me- | -Me- | -Me- |
TABLE 1-2
| No | $Ar^1$ | $Ar^2$ | $Ar^3$ | $Ar^4$ |
|---|---|---|---|---|
| 10 | 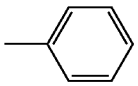 | 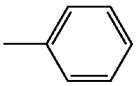 | 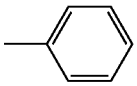 | 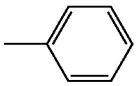 |
| 11 | 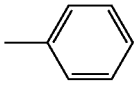 | 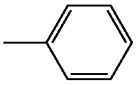 | 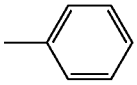 | 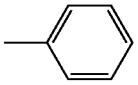 |
| 12 | 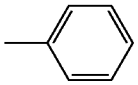 | 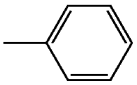 | 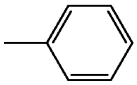 | 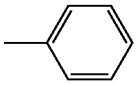 |
| 13 | 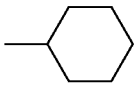 | 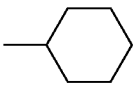 | 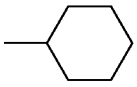 | 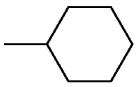 |
| 14 | 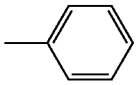 | 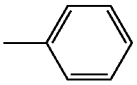 | 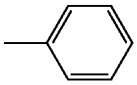 | 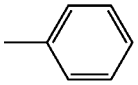 |

TABLE 1-2-continued
| | | | | |
|---|---|---|---|---|
| 15 | 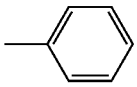 | 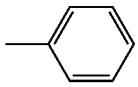 | 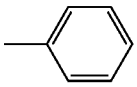 | 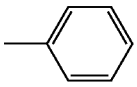 |
| 16 | 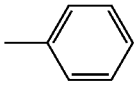 | 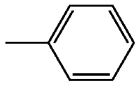 | 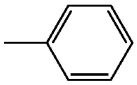 | 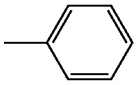 |
| 17 | 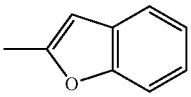 | 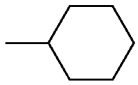 | 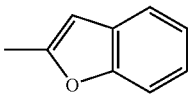 | 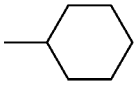 |
| 18 | 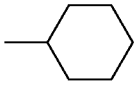 | 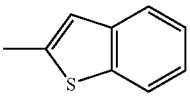 | 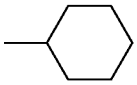 | 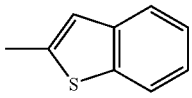 |
| 19 | 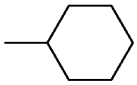 | 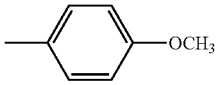 | 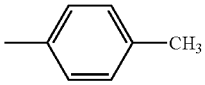 | 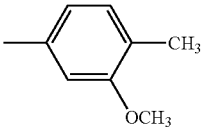 |
| No | $Ar^5$ | $Y^1$ | $Y^2$ | $Y^3$ | $Y^4$ | $Y^5$ | $Y^6$ |
|---|---|---|---|---|---|---|---|
| 10 | 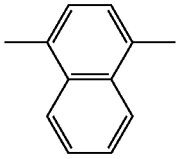 | -Me- | -Me- | -Me- | -Me- | -Me- | -Me- |
| 11 | 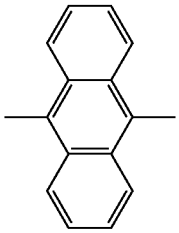 | -Me- | -Me- | -Me- | -Me- | -Me- | -Me- |
| 12 | 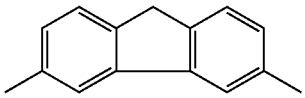 | -Me- | -Me- | -Me- | -Me- | -Me- | -Me- |
| 13 | 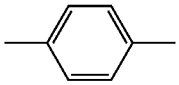 | -Me- | -Me- | -Me- | -Me- | -Me- | -Me- |
| 14 | 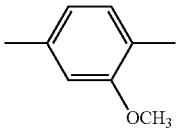 | -Me- | -Me- | -Me- | -Me- | -Me- | -Me- |
| 15 | 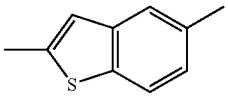 | -Me- | -Me- | -Me- | -Me- | -Me- | -Me- |
| 16 | 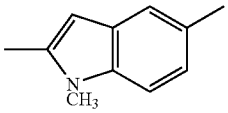 | -Me- | -Me- | -Me- | -Me- | -Me- | -Me- |

TABLE 1-2-continued
| | | | | | | | |
|---|---|---|---|---|---|---|---|
| 17 | 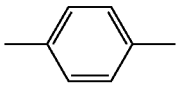 | -Me- | -Me- | -Me- | -Me- | -Me- | -Me- |
| 18 | 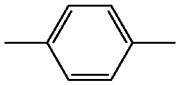 | -Me- | -Me- | -Me- | -Me- | -Me- | -Me- |
| 19 | 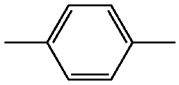 | -Me- | -Me- | -Me- | -Me- | -Me- | -Me- |
TABLE 1-3
| No | $Ar^1$ | $Ar^2$ | $Ar^3$ | $Ar^4$ | $Ar^5$ | $Y^1$ | $Y^2$ | $Y^3$ | $Y^4$ | $Y^5$ | $Y^6$ |
|---|---|---|---|---|---|---|---|---|---|---|---|
| 20 | 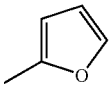 | 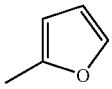 | 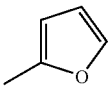 | 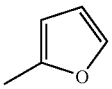 | 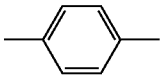 | -Me- | -Me- | -Me- | -Me- | -Me- | -Me- |
| 21 | 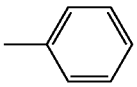 | 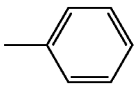 | 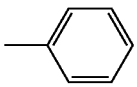 | 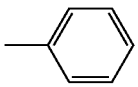 | 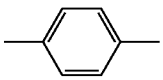 | -Me- | -Et- | -Me- | -Et- | -Me- | -Me- |
| 22 | 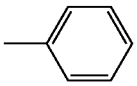 | 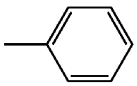 | 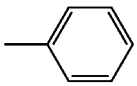 | 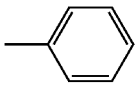 | 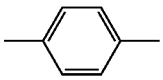 | -Me- | -Et- | -Me- | -Et- | -Et- | -Et- |
| 23 | 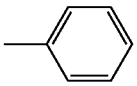 | 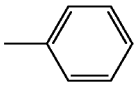 | 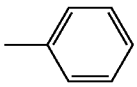 | 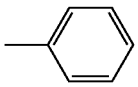 | 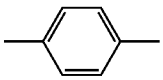 | -Me- | -Et- | -Me- | -Dm- | -Me- | -Me- |
| 24 | 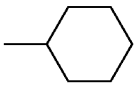 | 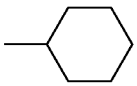 | 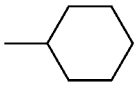 | 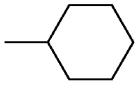 | 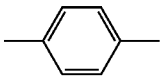 | -Me- | -Me- | -Me- | -Me- | -Et- | -Et- |
| 25 | 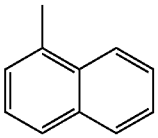 | 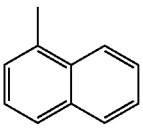 | 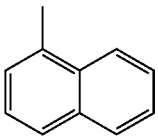 | 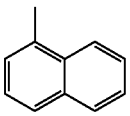 | 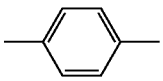 | -Me- | -Me- | -Me- | -Me- | -Me- | -Me- |
| 26 | 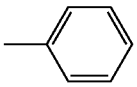 | 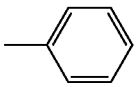 | 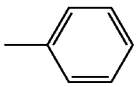 | 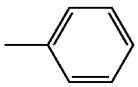 | 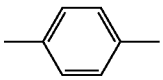 | -Dm- | -Me- | -Me- | -Me- | -Me- | -Me- |
| 27 | 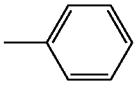 | 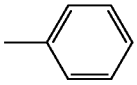 | 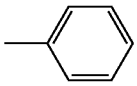 | 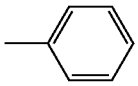 | 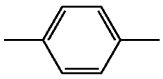 | -Dm- | -Me- | -Dm- | -Me- | -Me- | -Me- |
| 28 | 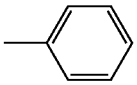 | 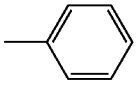 | 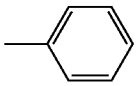 | 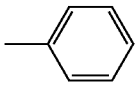 | 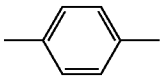 | -Et- | -Et- | -Et- | -Et- | -Et- | -Et- |
| 29 | 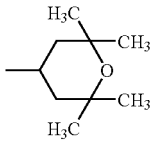 | 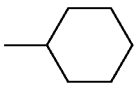 | 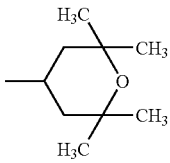 | 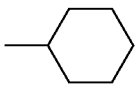 | 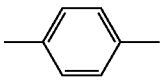 | -Et- | -Et- | -Me- | -Me- | -Et- | -Et- |

TABLE 1-4
| No | $Ar^1$ | $Ar^2$ | $Ar^3$ | $Ar^4$ |
|---|---|---|---|---|
| 30 | 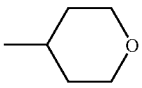 | 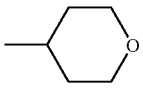 | 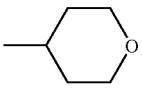 | 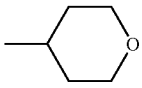 |
| 31 | 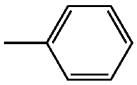 | 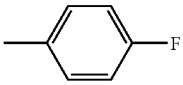 | 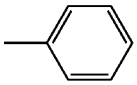 | 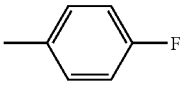 |
| 32 | 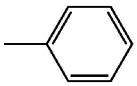 | 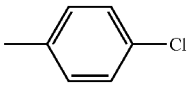 | 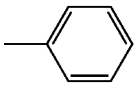 | 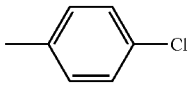 |
| 33 | 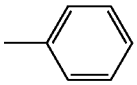 | 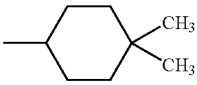 | 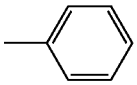 | 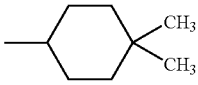 |
| 34 | 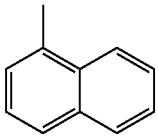 | 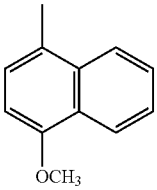 | 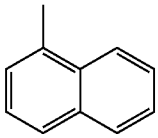 | 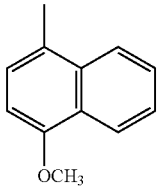 |
| 35 | 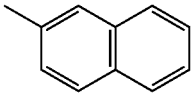 | 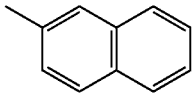 | 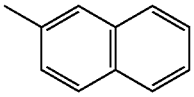 | 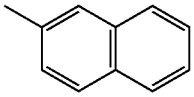 |
| 36 | 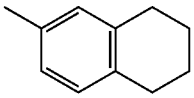 | 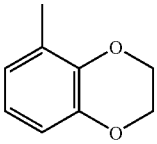 | 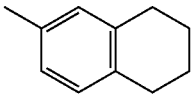 | 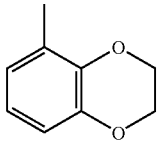 |
| No | $Ar^5$ | $Y^1$ | $Y^2$ | $Y^3$ | $Y^4$ | $Y^5$ | $Y^6$ |
|---|---|---|---|---|---|---|---|
| 30 | 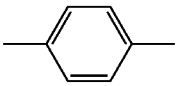 | -Me- | -Me- | -Me- | -Me- | -Me- | -Me- |
| 31 | 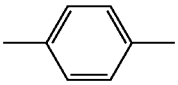 | -Me- | -Me- | -Me- | -Me- | -Me- | -Me- |
| 32 | 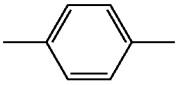 | -Me- | -Me- | -Me- | -Me- | -Me- | -Me- |
| 33 | 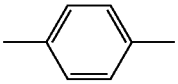 | -Me- | -Me- | -Me- | -Me- | -Me- | -Me- |
| 34 | 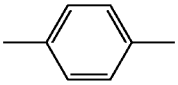 | -Me- | -Me- | -Me- | -Me- | -Me- | -Me- |
| 35 | 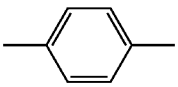 | -Me- | -Me- | -Me- | -Me- | -Me- | -Me- |

TABLE 1-4-continued

| | | | | | | | |
|---|---|---|---|---|---|---|---|
| 36 | 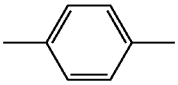 | -Me- | -Me- | -Me- | -Me- | -Me- | -Me- |

Among these diamine compounds listed in the above Tables, the exemplified compounds No. 1, 3, 7, 13, 21 and 28 are preferable from the point of synthetic easiness.

The diamine compound represented by the formula (I) according to the present invention may be produced by the method shown by the following reaction scheme. Specifically, a high-purity target amine compound may be produced simply in high yield by heating an amine compound represented by the formulae (V) and (VI) and a dihalogen compound represented by the formula (VII) in the presence of an organic amine base.

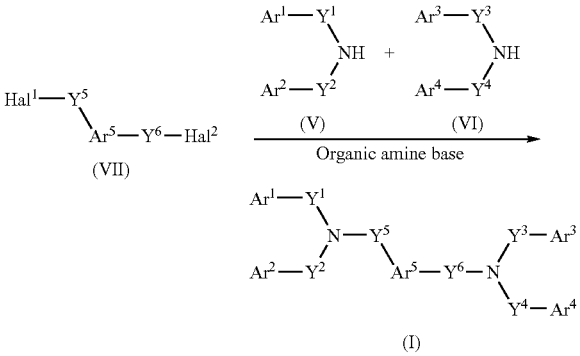

wherein $Ar^1$, $Ar^2$, $Ar^3$, $Ar^4$, $Ar^5$, $Y^1$, $Y^2$, $Y^3$, $Y^4$, $Y^5$ and $Y^6$ have the same meaning as those in the formula (I) and $Hal^1$ and $Hal^2$ each represent a halogen atom.

Examples of the halogen atom of $Hal^1$ and $Hal^2$ include a chlorine atom, bromine atom and iodine atom. Among these atoms, a chlorine atom and bromine atom are preferable from the viewpoint of reactivity and reaction yield.

The reaction of the above reaction scheme can be carried out, for example, in the following manner.

Secondary amine compounds (V) and (VI) and a dihalogen compound (VII) are dissolved or dispersed in a solvent, followed by addition of an organic amine base, with stirring under heating. After the reaction is finished, the precipitate is separated by filtration and then recrystallized from ethanol, methanol or ethyl acetate to be used singly or in combinations, thereby making possible to obtain a high-purity product to be intended, simply in a high yield.

Any solvent may be used as the solvent used in the above reaction without any particular limitation insofar as it is inert to the reaction and can dissolve or disperse the reaction substrate and the organic amine base.

Specific examples of the solvent include aromatic hydrocarbons such as toluene and xylene; ethers such as diethyl ether, tetrahydrofuran, ethyleneglycol dimethyl ether and 1,4-dioxane; amides such as N,N-dimethylformamide; sulfoxides such as dimethylsulfoxide. These solvents may be used either singly or as a mixed solvent.

In this case, no particular limitation is imposed on the amount of the solvent to be used and the amount of the solvent enough to carry out the reaction smoothly may be properly set corresponding to reaction conditions such as the amount of the reaction base material, reaction temperature and reaction time.

Examples of the above organic amine base include N,N-diisopropylethylamine, N,N-dimethylaminopyridine and 1,4-diazabicycl undecene.

There is not particular limitation to the ratio of the secondary amine compounds (V) and (VI) to the dihalogen compound (VII).

However, when a symmetric compound is obtained, that is, when either one of the secondary amine compounds (V) and (VI) is used, it is preferable to use about 2.0 to 2.3 equivalents of the secondary amine compound to one equivalent of the dihalogen compound (VII) in consideration of the efficiency of the reaction.

Also, when an asymmetric compound is obtained, that is, when both of the secondary amine compounds (V) and (VI) are used, it is preferable to use about 1.0 to 1.2 equivalents each of the secondary amine compounds (V) and (VI), that is, a total of about 2.0 to 2.4 equivalents of the secondary amine compounds (V) and (VI) to one equivalent of the dihalogen compound (VII) in consideration of the efficiency of the reaction.

It is preferable to use about 2.05 to 5.0 equivalents of the organic amine base to one equivalent of the dihalogen compound (VII) in consideration of reaction efficiency though no particular limitation is imposed on the ratio of the dihalogen compound (VII) to the organic amine base.

Also, there is no particular limitation to the reaction temperature and reaction time. However, the reaction temperature and reaction time are preferably 60 to 120° C. and 2 to 8 hours respectively in consideration of reaction efficiency though these conditions depend on the solvent to be used.

The diamine compound of the present invention can impart ozone resistance and resistance to oxidizing gases such as nitrogen oxide to the photoreceptor when it is contained in the outermost surface, that is, the surface protective layer, of the photoreceptor. This reason is inferred that the diamine compound of the present invention can trap oxidizing gases such as ozone, nitrogen oxides, chlorine oxides and sulfur oxides to prevent these oxidizing gases from adhering to the charge generation material contained in the charge generation layer and the charge transport material of the charge transport layer efficiently.

Therefore, the photoreceptor containing the diamine compound of the present invention in the surface protective layer of the photoreceptor has excellent electrophotographic properties, is resistant to the influence of ozone and nitrogen oxides generated from the system, and has stable characteristics and image qualities even if it is used repeatedly and can therefore attain very high durability.

The filler particles to be contained in the outermost surface layer, that is, the surface protective layer, of the photoreceptor is largely classified into an organic filler particle and an inorganic type filler particle including metal oxides.

Generally, organic filler particles including fluorine type materials are used for the purpose of controlling the wettability of a surface of the photoreceptor and for the purpose of limiting the sticking of foreign substances.

On the other hand, inorganic fillers are used in applications used for the purpose of improving printing durability.

In the present invention, the latter, that is, the inorganic filler particles are used to form the photoreceptor.

As to the characteristics of the inorganic filler particles, filler particles which have high hardness and are easily dispersed in a binder resin are preferable. Examples of these filler particles include oxides such as silicon oxide (silica), titanium oxide, zinc oxide, calcium oxide and aluminum oxide (alumina) and nitrogen compounds such as silicon nitride and aluminum nitride.

When these filler particles are added to the photoreceptor, they are not added simply in consideration of the amount to be added, but they are added to the surface protective layer of the photoreceptor in consideration of the dispersed state defined by Rf which is given by the following equation (1) taking the particle diameter of the filler particles and dispersed state into account and satisfies the following equation (2):

$$Rf=(df\times b^3)/(dm\times a^3) \quad (1)$$

$$1.0\times10^{-3}\leqq Rf\leqq 2.5\times10^{-2} \quad (2)$$

wherein a is an average distance (nm) between fillers, b is an average particle diameter (nm) of fillers, df is the a density ($g/cm^3$) of filler particles and dm is an average density ($g/cm^3$) of a solid in the surface protective layer.

The photoreceptor exhibits good printing durability under such a condition.

The above formula (1) is established on the premise that the fillers have a true sphere form and are uniformly distributed and that these particles are closely packed in the above medium.

In this case, the solid medium of the above outermost surface layer of the photoreceptor means the binder resin and charge transport material constituting the charge transport layer and the filler particles are distributed uniformly.

The average distance a between fillers is preferably measured precisely by TEM observation of the section. However, it may be found as a value calculated from the amount of the filler particles and volume of the coating film which is a medium if a uniformly dispersed state is confirmed.

Specifically, the average distance "a" can be measured from the amount, particle diameter and density of the filler particles to be added and the density of the medium (to say exactly, the density of all solid content containing the filler particles).

Though the average particle diameter "b" of the filler particles is preferably measured precisely by SEM observation of the section, it may be referred to the value described in the catalogues concerned if commercially available fillers are used.

The density "df" of the filler particles can be calculated from the volume and weight of the filler particles measured before they are used (according to JIS 7112). However, it may be referred to the value described in the catalogues concerned if commercially available fillers are used.

The average density "dm" of the solid in the outermost surface layer can be calculated from the volume and weight of the coating film measured after the coating film is formed.

The term "the solid content of the outermost surface layer" used in the present invention means the amount of the coating film of the surface protective layer obtained by applying the coating solution and solidifying by drying to remove a solvent.

Figure 3:
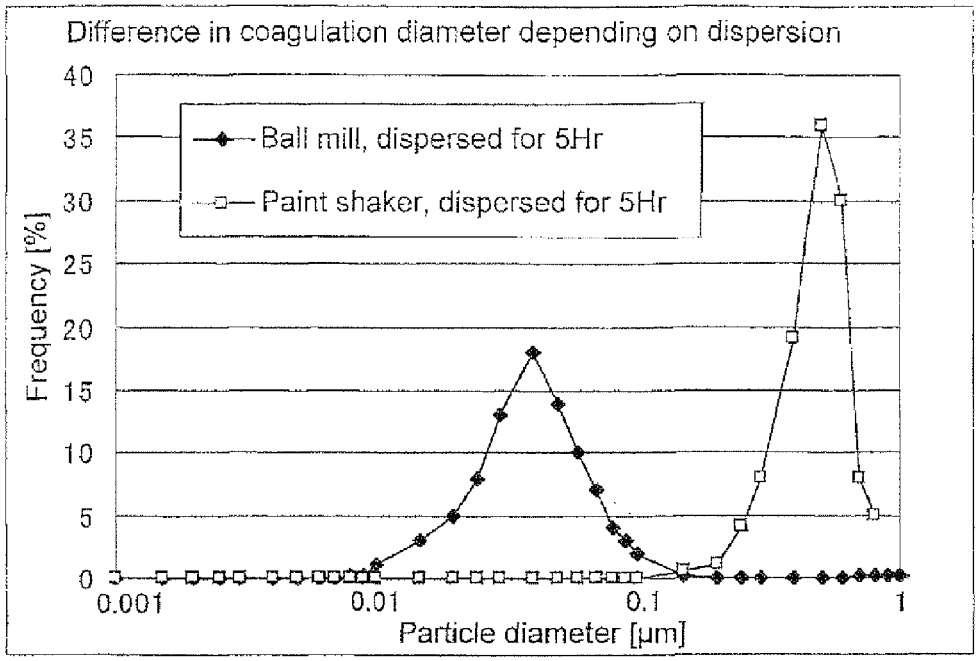
FIG. 3 is a view showing the relation of a difference in the diameter of coagulated particles to the dispersed condition of filler particles according to an embodiment of the present invention.

The uniformly dispersed state means such a state that a particle state close to the primary particle diameter as shown by "◆" in FIG. 3 in the coating solution is fixed after the coating film is solidified and the average particle diameter of the particles in the coating film is almost the same as the primary particle diameter of the raw material particles before the coating film is formed.

Specifically, in the above formula (1), it is assumed that these fillers each have a true sphere form and no grain distribution and are uniformly dispersed in the above medium.

If the amount, particle diameter and density of the filler particles and the density of the medium (exactly, the density of all solid containing filler particles) are determined, the average distance a between filler particles is determined. Substituting the obtained value a in the equation (1), it can be decided whether or not the filler particles satisfy the equation (1).

In other words, the equation (1) is established on the premise that the filler particles are uniformly "distributed".

Therefore, in the present invention, the concentration of the filler particles to be added is so defined that the filler particles are dispersed uniformly in the coating solution/coating film and satisfy the above equation (1).

The average distance a between filler particles is preferably small to reduce the scattering of light and harmful effects on electric carriers (electrons and/or holes) in the system to minimum. Specifically, the distance "a" is preferably 400 nm or less (primary particle diameter) and more preferably 20 to 200 nm.

The average particle diameter "b" of the filler particles is preferably 5 to 100 nm and particularly preferably 5 to 20 nm.

The density "df" of the filler particles is preferably 1.5 to 7 $g/cm^2$ and particularly preferably 1.5 to 3 $g/cm^2$.

The average density "dm" of a solid in the outermost surface layer is preferably 1 to 2 $g/cm^2$ and particularly preferably 1 to 1.5 $g/cm^2$.

When the filler particles are added, known dispersing techniques using a ball mill, sand mill, attritor, vibration mill, ultrasonic dispersing machine or paint shaker may be used to form a uniformly dispersed state. Then, it is desired to grasp the dispersed state of the particles in the dispersion solution used to form a coating film of the outermost layer of the photoreceptor or after the coating film is formed, to draw the excellent properties of the electrophotographic photoreceptor.

FIG. 3 is a view showing the state of grain distribution in two types of coating solutions using the same formulation after these coating solutions are dispersed.

To describe in more detail, 3.1 g of a polycarbonate resin (trade name: TS2050, manufactured by Teijin Chemicals Ltd.) and 3.1 g of silica (trade name: TS610, manufactured by Cabot Specialty Chemicals, primary particle diameter: 17 nm) were mixed in 55.9 g of tetrahydrofuran. The obtained 2 mixtures were subjected to dispersion treatment using a ball mill and a paint shaker respectively for 5 hours and the grain distribution of silica particles in each of the obtained coating solutions were measured.

In FIG. 3, "◆" indicates the ball mill treatment and "□" indicates the paint shaker treatment.

It is found from FIG. 3 that the particles of "◆" are stably dispersed into a particle state having a size close the primary particle diameter whereas the particles of "□" form an aggregate of the order of micron. Specifically, it is sure that "□" shows that an aggregate resulting from recoagulation is formed. However, the detailed reason why this state is obtained has not been clarified.

The change in coagulation state as shown in FIG. 3 corresponds directly to the electric properties and uniformity of a surface of the final coating film and the formation of a uniform dispersion of particles having a diameter close to the primary particle diameter is also reflected in the coating film. Accordingly, the dispersion techniques of "◆" resultantly enable the formation of the outermost surface layer superior in durability and is hence desirable.

In the above explanations, a preferred example of non-aggregated filler particles is given. However, if the equation (1) is satisfied, an aggregate of filler particles may be used. In the case of an aggregate, the term "filler particles" in a, b and df of the equation (1) is replaced with the term "aggregate". Also, although in the above explanations, the dispersion treatment using a paint shaker is carried out in the condition sufficient to form an aggregate, particles can be dispersed in the state of particles having a diameter close to the primary particle diameter by changing the condition.

The dispersed state of the filler particles in the above coating solution may be evaluated using, for example, a light scattering type grain distribution measuring device.

It has been found that as to the type of inorganic filler particles, silicon oxide having a small difference in refractive index from the medium is preferable as the result of consideration of light scattering in the system, and also, filler particles having a small particle diameter are preferable to decrease light scattering and harmful effects on electric carriers in the system.

Specifically, silica providing the above filler particles having a particle diameter of 100 nm or less is preferable and silica having an average particle diameter of, preferably, 0.1 to 70 nm, more preferably 1 to 40 nm and even more preferably 5 to 30 nm is desirable.

Next, a method of forming the surface protective layer will be explained in detail.

The surface protective layer of the present invention may be formed by dissolving or dispersing the compounds referred to in detail in the above explanations, that is, a diamine compound, filler particles exhibiting a dispersed state defined by "Rf", a binder resin and, according to the need, a charge transport material and other additives in a proper solvent to prepare a surface protective layer-forming coating solution, which is then applied to a surface of the charge transport layer, followed by drying to remove the solvent.

More specifically, the surface protective layer forming coating solution is prepared, for example, by dissolving or dispersing, according to the need, other additives in a resin solution produced by dissolving a binder resin in a solvent.

As the binder resin to be used in the surface protective layer, a material is desirable which can use a resin which is used for the purpose of improving, for example, the mechanical strength and durability of the charge generation layer, has binding ability and is used in the fields concerned.

Specific examples of the binder resin include thermoplastic resins such as a polymethylmethacrylate, polystyrene, vinyl type resins, for example, a polyvinyl chloride, polycarbonate, polyester, polyester carbonate, polysulfone, polyarylate, polyamide, methacryl resins, acryl resins, polyether, polyacrylamide and polyphenylene oxide; heatcurable resins such as phenoxy resins, epoxy resins, silicone resins, polyurethane, phenol resins, alkyd resins, melamine resins, phenoxy resins, polyvinylbutyral and polyvinylformal, partially crosslinked products of these resins and copolymer resins containing two or more structural units contained in these resins (insulation resins such as a vinyl chloride/vinyl acetate copolymer resin, vinyl chloride/vinyl acetate/maleic acid anhydride copolymer resin and acrylonitrile/styrene copolymer resin).

These binder resins can be used either singly or in combinations of two or more. It is preferable to use binders compatible with the diamine compound of the present invention. For example, thermoplastic resins such as a polycarbonate and a siloxane resin which is expected to have high mechanical strength because it has a three-dimensional structure are also preferable.

Further, examples of the solvent which dissolves and disperses resin materials include aromatic hydrocarbons such as benzene, toluene, xylene, mesitylene, tetralin, diphenylmethane, dimethoxybenzene and dichlorobenzene; hydrocarbon halides such as dichloro methane, dichloroethane and tetrachloropropane; ethers such as tetrahydrofuran (THF), dioxane, dibenzyl ether, dimethoxymethyl ether and 1,2-dimethoxyethane; ketones such as methyl ethyl ketone, cyclohexanone, acetophenone and isophrone; esters such as methyl benzoate, ethyl acetate and butyl acetate; sulfur-containing solvents such as diphenyl sulfide; fluorine type solvents such as hexafluoroisopropanol; and aprotic polar solvents such as N,N-dimethylformamide and N,N-dimethylacetamide. These compounds may be used either singly or in combinations of two or more.

Mixed solvents obtained by adding alcohols, acetonitrile or methyl ethyl ketone to the above solvents can be also used. Among these solvents, non-halogen type organic solvents are more preferable in consideration of global atmosphere.

Next, the structures of the photoreceptor other than the surface protective layer according to the present invention will be explained in detail.

Figure 2:
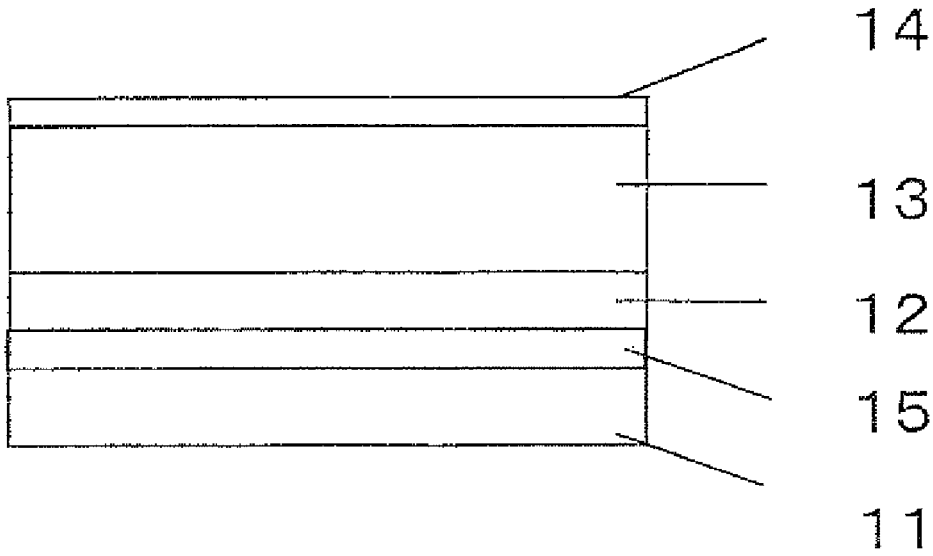
FIG. 2 is a typical sectional view showing the structure of an essential part of a laminate type photoreceptor according to the present invention.

FIGS. 1 and 2 are typical sectional views showing the structure of essential parts in the photoreceptor of the present invention.

Specifically, FIGS. 1 and 2 are typical sectional views showing the structure of essential parts of a laminate type photoreceptor in which the photosensitive layer is a laminate type photosensitive layer constituted of a charge generation layer, a charge transport layer and a surface protective layer. Although the photoreceptor of the present invention may have an inverse two-layer type laminate structure in which the charge generation layer and the charge transport layer are laminated in inverse order, the above laminate type is preferable.

A photoreceptor 1 of FIG. 1 is formed by laminating a charge generation layer 12, a charge transport layer 13 and a surface protective layer 14 in this order on a surface of a conductive support 11.

A photoreceptor 2 of FIG. 2 is formed by laminating an intermediate layer 15, a charge generation layer 12, a charge transport layer 13 and a surface protective layer 14 in this order on a surface of a conductive support 11.

(Conductive Support 11 (Photoreceptor Raw Pipe))

The conductive substrate 11 plays a role of the electrode of the photoreceptor and any material may be used without any particular limitation as long as it is a material used in the fields concerned.

Specific examples of the structural material of the conductive support include metal materials such as aluminum, aluminum alloys, copper, zinc, stainless steel and titanium; and structural materials prepared by laminating a metal foil, forming a metal material by vapor deposition or forming a layer of a conductive compound such as a conductive polymer, tin oxide or indium oxide by vapor deposition or application, on a surface of a substrate made of high-molecular materials such as a polyethylene terephthalate, polyamide, polyester, polyoxymethylene and polystyrene, hard paper or glass.

The form of the conductive support is not limited to a cylinder form and may be a sheet form, columnar form or endless belt form.

The surface of the conductive substrate 11 may be subjected, according to the need, to anodic oxidation coating treatment, surface treatment using chemicals or hot water, coloring treatment or irregular reflection treatment in which the surface is roughened to the extent that an image is not adversely affected.

The irregular reflection treatment is particularly effective when the photoreceptor according to the present invention is used in the electrophotographic process using a laser as the exposure light source. Specifically, in the electrophotographic process using a laser as the exposure light source, the wavelengths of the laser light are even and therefore, the laser light reflected on a surface of the photoreceptor and the laser light reflected in the inside of the photoreceptor are interfered with each other, which is probably the cause of the generation of image defects because an interference fringe resulted from the above interference appears on the image.

Therefore, the image defects due to the interference of laser light having even wavelengths can be prevented by processing a surface of the conductive support by the irregular reflection treatment.

(Intermediate Layer 15)

The photoreceptor of the present invention is preferably provided with an intermediate layer between the conductive support and the laminate type photosensitive layer.

The intermediate layer has the ability to prevent charges from being injected into the laminate type photoreceptor layer from the conductive support. Specifically, it prevents a deterioration in the charging ability of the laminate type photosensitive layer and limits a reduction in surface charge on the part other than that to be erased by exposure, thereby preventing the generation of image defects such as fogging. In particular, the intermediate layer prevents the generation of image fogging called black points formed as small black dots made of a toner on the white background part in the formation of an image by the inverse developing process.

Also, the intermediate layer which covers a surface of the conductive support reduces the level of irregularities which are the defects of a surface of the conductive support to thereby make the surface uniform, making it possible to improve the film forming ability of the laminate type photosensitive layer and to improve the adhesion between the conductive support and the laminate type photosensitive layer.

The intermediate layer may be formed, for example, by dissolving a resin material in a proper solvent to prepare an intermediate layer-forming coating solution, which is then applied to a surface of the conductive support, followed by drying to remove the solvent.

Also, the resin material, solvent and the like accord to those used in the production of the surface protective layer coating solution.

Also, the intermediate layer-forming solution may contain metal oxide particles.

The metal oxide particles can easily control the volume resistance of the intermediate layer, can further limit the injection of charges into the laminate type photosensitive layer and can also maintain the electric properties of the photoreceptor under various environments.

Examples of the metal oxide particles include titanium oxide, aluminum oxide, aluminum hydroxide and tin oxide. The particle diameter of these particles is preferably in a range from 0.02 to 0.5 μm.

When the total content of the resin material and metal oxide particles in the intermediate layer-forming coating solution is C and the content of the solvent is D, the ratio (C/D) by weight of the both is preferably 1/99 to 40/60 and particularly preferably 2/98 to 30/70.

Further, the ratio (E/F) of the content (E) of the resin material to the content (F) of the metal oxide particles is preferably 1/99 to 90/10, and particularly preferably 5/95 to 70/30.

The film thickness of the intermediate layer is preferably 0.01 to 20 μm and more preferably 0.05 to 10 μm, though no particular limitation is imposed on it.

When the film thickness of the intermediate layer is less than 0.01 μm, the function as the intermediate layer is not substantially exhibited and there is therefore a fear that the formed intermediate layer fails to attain the purpose of coating the defects of the conductive support to obtain a uniform surface, whereas when the film thickness of the intermediate layer exceeds 20 μm, it is difficult to form a uniform intermediate layer and there is therefore a fear that the sensitivity of the photoreceptor is also deteriorated.

When the structural material of the conductive support is aluminum, a layer containing alumite (alumite layer) may be formed as an intermediate layer.

(Charge Generation Layer 12)

The charge generation layer is formed of a charge generation material and a binder resin.

Compounds used in the fields concerned may be used as the charge generation material.

Specific examples of the charge generation material include organic pigments or dyes (organic photoconductive materials) such as azo type pigments (for example, monoazo type pigments, bisazo type pigments and trisazo type pigments), indigo type pigments (for example, indigo and thioindigo), perylene type pigments (for example, perylene imide and perylenic acid anhydride), polycyclic quinone type pigments (for example, anthraquinone and pyrene quinone), phthalocyanine type pigments (for example, metal phthalocyanine and nonmetal phthalocyanine), squalilium dyes, pyrylium salts and thiopyrylium salts, triphenylmethane type dyes (for example, Methyl Violet, Crystal Violet, Night Blue and Victoria Blue), acridine type dyes (for example, erythrosine, Rhodamine B, Rhodamine 3R, Acridine Orange and Flapeosine), thiazine type dyes (for example, Methylene Blue and Methylene Green), oxazine type dyes (for example, Capryl Blue and Meldola's Blue), bisbenzoimidazole type dyes, quinacridone type dyes, quinoline type dyes, lake type dyes, azo lake type dyes, dioxazine type dyes, azulenium type dyes, trialylmethane type dyes, xanthene type dyes and cyanine type dyes. These charge generation materials may be used either singly or in combinations of two or more.

Among these charge generation materials, oxotitanium phthalocyanine compounds represented by the following formula (2) are preferable.

(2)

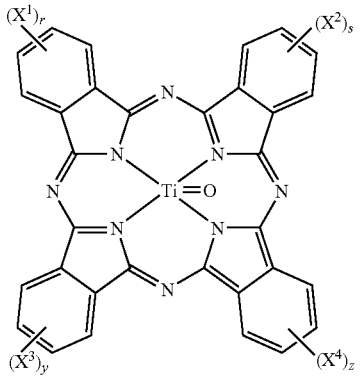

Wherein $X^1$, $X^2$, $X^3$ and $X^4$, which may be the same or different, each represent a halogen atom, an alkyl group or an alkoxy group and r, s, y and z, which may be the same or different, respectively denote an integer from 0 to 4.

Examples of the halogen atom of $X^1$, $X^2$, $X^3$ or $X^4$ include a fluorine atom, a chlorine atom and an iodine atom.

Examples of the alkyl group of $X^1$, $X^2$, $X^3$ or $X^4$ include alkyl groups having 1 to 4 carbon atoms such as a methyl group, ethyl group, propyl group, isopropyl group, butyl group, isobutyl group and t-butyl group.

Examples of the alkoxy group of $X^1$, $X^2$, $X^3$ or $X^4$ include a methoxy group, ethoxy group, propoxy group, isopropoxy group, butoxy group, isobutoxy group and t-butoxy group.

Because the oxotitanium phthalocyanine compound represented by the above structural formula (2) has high charge generation efficiency and charge injection efficiency, it absorbs light to generate a large number of charges and also, the charges are not accumulated in its molecule but are efficiently injected into the charge transport material of the charge transport layer and transported smoothly, making it possible to a photoreceptor having high sensitivity and high resolution.

The oxotitanium phthalocyanine compound represented by the above structural formula (2) is produced by a known production method such as the method described in Moser, Frank H and Arthur L. Thomas, Phthalocyanine Compounds, Reinhold Publishing Corp., New York, 1963.

Among oxotitanium phthalocyanine compounds represented by the above structural formula (2), an unsubstituted oxotitanium phthalocyanine obtained when r, s, y and z are respectively 0 in the above structural formula (2) is obtained in the following manner: phthalonitrile and titanium tetrachloride are melted under heating or reacted under heating in a proper solvent such as α-chloronaphthalene to synthesize dichlorotitanium phthalocyanine, which is then hydrolyzed by a base or water.

Also, oxotitanium phthalocyanine can be produced by reacting isoindoline with titanium tetraalkoxide such as tetrabutoxy titanium under heating in a proper solvent such as N-methylpyrrolidone.

As the solvent used to dissolve or disperse the binder resin and charge generation material, binder resins listed when referred to the above surface protective layer may be used.

No particular limitation is imposed on the ratio of the charge generation material to the binder resin. However, when the weight of the charge generation material is G and the weight of the binder resin is B, the ratio G/B is preferably 10/100 or more and 200/10 or less, and particularly preferably 50/150 or more and 150/100 or less.

When the ratio G/B is less than 10/100, there is the case where the sensitivity of the photoreceptor is deteriorated.

When the ratio G/B exceeds 200/100, on the other hand, there is the case where the film strength of the charge generation layer is lowered and the dispersibility of the charge generation material is deteriorated, bringing about an increase in coarse particles and there is therefore the case where the surface charge on a part other than the part to be erased is decreased by the exposure, causing image defects and particularly increased image fogging called "black points" known as the phenomenon that a toner is stuck to the white background to form fine black dots.

Also, the charge generation layer may contain one or two or more types of a chemical sensitizer and optical sensitizer in appropriate amount to the extent that the preferable characteristics Of the present invention are not impaired. These sensitizers improve the sensitivity of the photoreceptor, limit a rise in residual potential and fatigue caused by repeated use, to thereby improve electric durability.

A proportion of the chemical sensitizer and/or optical sensitizer to be used is, though not particularly limited to, preferably 10 parts by weight or less and more preferably 0.5 to 2.0 parts by weight based on 100 parts by weight of the charge generation material.

Examples of the chemical sensitizer include electron attractive materials, for example, acid anhydrides such as succinic acid anhydride, maleic acid anhydride, phthalic acid anhydride and 4-chloronaphthalic acid anhydride; cyano compounds such as tetracyanoethylene, terephthalmalondinitrile; aldehydes such as 4-nitrobenzaldehydes; anthraquinones such as anthraquinone and 1-nitroanthraquinone; polycyclic or heterocyclic nitro compounds such as 2,4,7-trinitrofluorenone and 2,4,5,7-tetranitrofluorenone; and diphenoquinone compounds, and macromolecular compounds obtained by polymerizing these electron attractive materials.

Examples of the optical sensitizer include organic photoconductive compounds such as xanthene type dyes, quinoline type pigments and copper phthalocyanine; triphenylmethane type dyes typified by Methyl Violet, Crystal Violet, Night Blue and Victoria Blue; acridine dyes typified by Erythrocin, Rhodamine B, Rhodamine 3R, Acridine Orange and Flapeosine; thiazine dyes such as Methylene Blue and Methylene Green; oxazine dyes such as Capryl Blue, Meldola's Blue; cyanine dyes; styryl dyes; pyrylium salt dyes and thiopyrylium salt dyes.

The film thickness of the charge generation layer 12 is, though not particularly limited to, preferably 0.05 to 5 μm, and particularly preferably 0.1 to 1.5 μm.

This is because when the film thickness of the charge generation layer is less than 0.05 μm, there is a fear that the light absorption efficiency is dropped, bringing about low sensitivity, whereas when the film thickness of the charge generation layer exceeds 5 μm, the transport of charges in the charge generation layer is the rate determining step in the process of erasing charges on a surface of the photoreceptor and there is therefore a fear that the sensitivity is deteriorated.

(Charge Transport Layer 13)

The charge transport layer 13 is formed of a charge transport material and a binder resin.

The charge transport material has the ability to accept and transport the charges generated in the charge generation material, and includes those which have hole transport ability or electron transport ability.

As the hole transport material, compounds used in the fields concerned can be used.

Specific examples of the charge transport material include carbazole derivatives, pyrene derivatives, oxazole derivatives, oxadiazole derivatives, thiadiazole derivatives, triazole derivatives, imidazole derivatives, imidazolone derivatives, imidazolidine derivatives, bisimidazolidine derivatives, styryl compounds, hydrazone compounds, polycyclic aromatic compounds, indole derivatives, pyrazoline derivatives, oxazolone derivatives, benzimidazole derivatives, quinazoline derivatives, benzofuran derivatives, acridine derivatives, phenazine derivatives, aminostilbene derivatives, triarylamine derivatives, triaryimethane derivatives, phenylenediamine derivatives, stilbene derivatives, enamine derivatives, benzidine derivatives, polymers having groups derived from these compounds on their principal chains or side chains (for example, a poly-N-vinylcarbazole, polylvinylpyrene, ethylcarbazole-formaldehyde resin, triphenylmethane polymer and poly-9-vinylanthracene) and polysilane. These hole transport materials may be used either singly or in combinations of two or more.

As the electron transport material, compounds used in the fields concerned may be used.

Specific examples of the electron transport material include benzoquinone derivatives, tetracyanoethylene derivatives, tetracyanoquinodimethane derivatives, fluorenone derivatives, xanthone derivatives, phenanthraquinone derivatives, phthalic acid anhydride derivatives and diphenoquinone derivatives. These charge transport materials may be used either singly or in combinations of two or more.

As the binder resin, one or two or more of the binder resins listed when referred to the above surface protective layer may be used.

Among these resins, a polystyrene, polycarbonate, polyarylate and polyphenylene oxide are preferable because they respectively have a volume resistance of $10^{13}\Omega$ or more, so that they are superior in electric insulation ability and also in film forming ability and potential characteristics and a polycarbonate is more preferable.

Though there is no particular limitation to the ratio of the charge transport material to the binder resin, the ratio T/B is preferably 10/30 or more and 10/12 or less when the weight of the charge transport material is T and the weight of the binder resin is B.

When the ratio T/B is less than 10/30 so that the ratio of the binder is increased in the case of forming the charge transport layer by the dip coating method, there is a fear that the carrier mobility in the charge transport layer is dropped, with the result that the sensitivity of the photoreceptor is deteriorated.

When the ratio T/B exceeds 10/12 so that the ratio of the binder is reduced, on the other hand, the printing durability of the photoreceptor is lowered, bringing about an increase in the reduction of film thickness and there is therefore a fear that the chargeability of the photoreceptor is deteriorated.

The charge transport layer may contain, besides the above two essential components, the same additives as those used in the charge generation layer according to the need.

The film thickness of the charge transport layer is preferably 5 to 40 μm, and particularly preferably 10 to 30 μm, though no particular limitation is imposed on it.

When the film thickness of the charge transport layer is less than 5 μm, there is a fear that the charge retentivity of a surface of the photoreceptor is deteriorated whereas when the film thickness of the charge transport layer exceeds 40 μm on the other hand, there is a fear as to a deterioration in the resolution of the photoreceptor.

The method of producing the photoreceptor according to the present invention involves drying processes in the production of each of, for example, the intermediate layer 15, charge generation layer 12, charge transport layer 13 and surface protective layer 14.

The drying temperature of the photoreceptor is properly about 50° C. to about 140° C. and preferably about 80° C. to 130° C. When the drying temperature of the photoreceptor is less than about 50° C., there is the case where the drying time is longer, whereas when the drying temperature exceeds about 140° C., there is the case where the electric properties in repeated use are impaired and an image obtained by using the photoreceptor is deteriorated.

An image formation device according to the present invention is characterized by the feature that it is provided with the photoreceptor of the present invention, a charging means that charges the photoreceptor, an exposure means that exposes the photoreceptor to light, a developing means that develops the electrostatic latent image formed by the exposure and a transfer means that transfers the electrostatic latent image to a transfer material.

The image formation device (laser printer) of the present invention will be explained with reference to the drawings, though the present invention is not limited to this laser printer.

Figure 4:
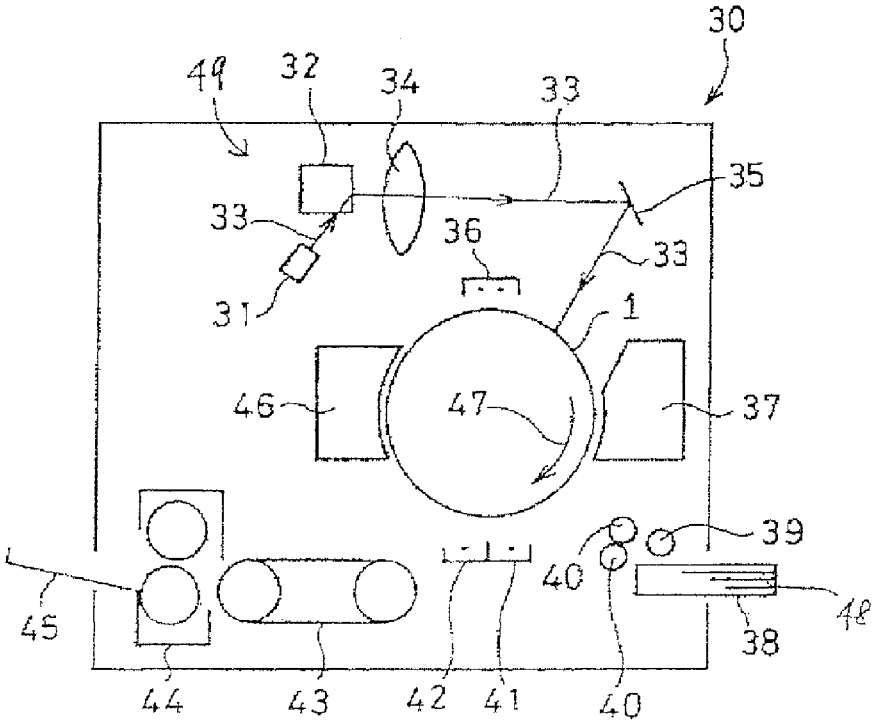
FIG. 4 is a typical side view showing the structure of an image formation device according to the present invention.

FIG. 4 is a typical side view showing the structure of the image formation device of the present invention.

A laser printer 30 that is the image formation device has a structure provided with a photoreceptor 1, a semiconductor laser (or light-emitting diode) 31, a rotating polygon mirror 32, an imaging lens 34, a mirror 35, a corona charger 36 that is the charging device, a developing unit 37 that is the developing device, a transfer paper cassette 38, a paper feed roller 39, a resist roller 40, a transfer charger 41 that is the transfer device, an isolation charger 42, a conveyer belt 43, a fixing unit 44, a discharge tray 45 and a cleaner 46 that is the cleaning device.

In this case, the above semiconductor laser 31, the rotating polygon mirror 32 and the imaging lens 34 and the mirror 35 constitute an exposure device 49.

The photoreceptor 1 is mounted on the laser printer 30 such that it can be rotated in the direction of the arrow 47 by a driving means (not shown). A laser beam 33 emitted from a semiconductor laser 31 is used to scan a surface of the photoreceptor 1 repeatedly in the longitudinal direction (major scanning direction) by the rotating polygon mirror 32. The imaging lens 34 has the f-θcharacter and therefore, the laser beam 33 is reflected by the mirror 35 to form an image on a surface of the photoreceptor 1, thereby accomplishing exposure. The photoreceptor 1 is scanned by the laser beam 33 with rotating the photoreceptor 1 in the above manner to form an image, thereby forming an electrostatic latent image corresponding to image information on the photoreceptor 1.

The charger 36, developing unit 37, transfer charger 41 and isolation charger 42 and cleaner 46 are arranged in this order towards the downstream side from upstream side in the direction of the rotation of the photoreceptor 1 as shown by the arrow 47.

Also, the charger 36 is disposed on the upstream side of the imaging point of the laser beam 33 in the direction of the rotation of the photoreceptor 1 to charge a surface of the photoreceptor 1 uniformly. Therefore, when a surface of the photoreceptor 1 charged uniformly is exposed, the charge amount of the part which is exposed by the laser beam 33 is different from that of the part which is not exposed by the laser beam 33 to thereby form the above electrostatic latent image.

The charger 36 is disposed on the outer peripheral surface of the photoreceptor drum 3 on the side almost opposite to the position where the transfer belt unit 8 is disposed, with the photoreceptor drum 3 being interposed between the charger 36 and the transfer belt unit 8. Herein, as the charger 36, a non-contact charging type corona charger as shown in FIG. 4 or a direct charging type roller charger or brush type charger (not shown) may be utilized.

In the corona charger, the oxidation of the photoreceptor layer is accelerated because ozone, NOx and the like are generated, though the photoreceptor layer is a non-contact type and therefore has high wear resistance. On the other hand, in the direct contact system such as roller charger, the above generation of gas is suppressed. However, the abrasion of the photoreceptor is accelerated by mechanical contact. Accordingly, since the photoreceptor of the present invention is provided with the surface protective layer having higher mechanical strength than the charge transport layer, it can produce higher effects when used in the contact charging system.

The developing unit 37 is disposed on the downstream side of the imaging point of the laser beam 33 in the direction of the rotation of the photoreceptor 1, supplies a toner to the electrostatic latent image formed on a surface of the photoreceptor 1 to develop the electrostatic latent image into a toner image.

Here, as the developer 37, a two components developer or mono component developer may be utilized. In the mono component developer, either a magnetic or nonmagnetic toner may be utilized. When a mono component magnetic developing system is used, a reduction in the thickness of the photosensitive layer is more increased than in the case of using a two components developer. Accordingly, since the photoreceptor of the present invention is provided with the surface protective layer having higher mechanical strength than the charge transport layer, it can produce higher effects when using a mono component developer.

A transfer paper 48 received in the transfer paper cassette 38 is taken out one by one by the paper feed roller 39 and is provided to the transfer charger 41 synchronously with the exposure of the photoreceptor 1 by the resist roller 40. The toner image is transferred to the transfer paper 48 by the transfer charger 41. The isolation charger 42 disposed close to the transfer charger 41 removes charges from the transfer paper to which the toner image has been transferred, to thereby separate the paper from the photoreceptor 1.

The transfer paper 48 separated from the photoreceptor 1 is conveyed to the fixing device 44 by the conveyer belt 43 and the toner image is fixed by the fixing device 44. The transfer paper 48 is discharged to the paper discharge tray 45. After the transfer paper 48 is separated by the isolation charger 42, the photoreceptor 1 continued rotating is cleaned to remove a toner residue and foreign substances left on a surface of the photoreceptor 1 by a cleaner 46. The charges of the photoreceptor 1, a surface of which is cleaned is removed by a charge-removing lamp (not shown) installed together with the cleaner 46 and then, the photoreceptor 1 is further rotated, and a series of image formation operations starting from the charging of the photoreceptor 1 are repeated.

Also, a structure capable of forming an overlapped image by using plural toners by providing plural photoreceptors may be adopted. This structure is called "tandem system".

EXAMPLES

The present invention will be explained in detail by way of Production Examples, Examples and Comparative Examples, which are not intended to be limiting of the present invention.

Production Example 1

(Production of an amine-bisaldehyde intermediate)

One equivalent of 4,4'-bis(chloromethyl)benzene and 2.1 equivalents of dibenzylamine were added in 50 ml of 1,4-dioxane anhydride and the mixture was cooled under ice-cooling in an ice bath. 2.2 equivalents of N-diisopropylethylamine were added gradually in this solution. Then, the solution was gradually heated to a reaction temperature of 100 to 110° C. and stirred for 4 hours with heating so as to keep the solution at a temperature of 100 to 110° C. After the reaction was completed, this reaction solution was allowed to cool. Then, the produced precipitate was collected by filtration, washed sufficiently with water and then recrystallized from a mixed solvent of ethanol and ethyl acetate (ethanol: ethyl acetate=8:2 to 7:3), to obtain 12.1 g of the exemplified compound No. 1 as a white powdery compound.

The exemplified compound No. 1 was synthesized according to the following reaction scheme using dibenzylamine as the amine compounds represented by the general formula (V) and (VI) and 4,4'-bis(chloromethyl)benzene as the dihalogen compound represented by the general formula (VII) in the above reaction scheme,

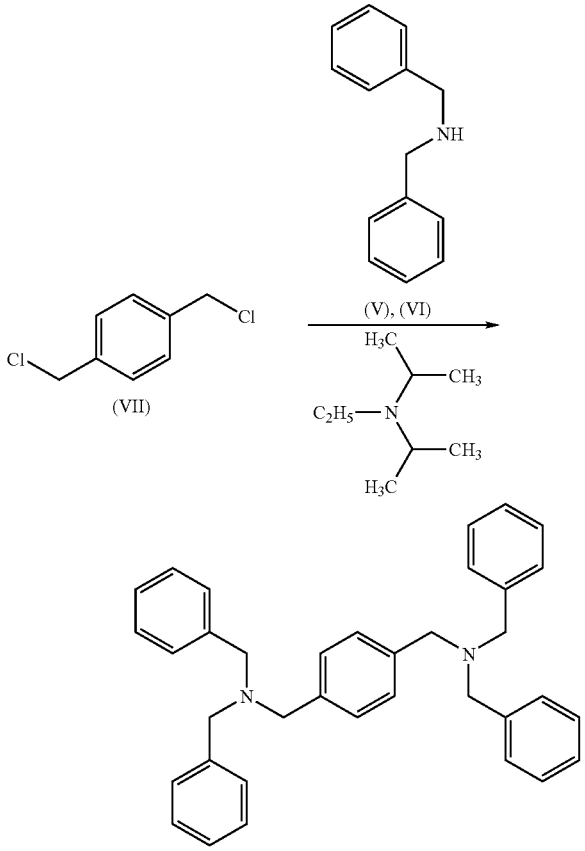

Exemplified compound No. 1

Production Examples 2 to 11

The same operations as in Production Example 1 were conducted using each raw material compound shown in Table 2 as the amine compound represented by the general formulae (V) and (VI) and as the dihalogen compound represented by the general formula (VII), to synthesize the exemplified compounds No. 3, 7, 13, 21 and 28. In Table 2, the raw material compounds of the exemplified compound No. 1 are shown together.

TABLE 2

| Compound | Amine Compound Formulae (V) and (VI) | | Dihalogen compound Formula (VII) |
|---|---|---|---|
| Production Example 1 Exemplified compound No. 1 | 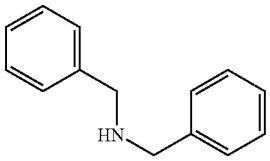 | 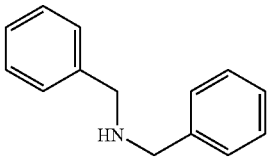 | 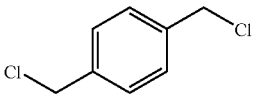 |

TABLE 2-continued

| Compound | Amine Compound Formulae (V) and (VI) | | Dihalogen compound Formula (VII) |
|---|---|---|---|
| Production Example 3 Exemplified compound No. 3 | 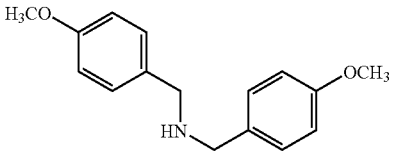 | 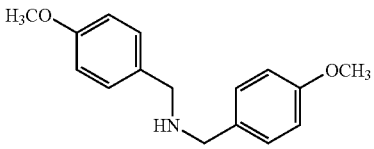 | 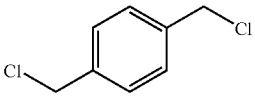 |
| Production Example 4 Exemplified compound No. 7 | 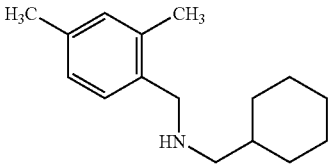 | 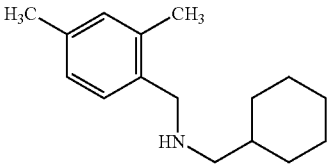 | 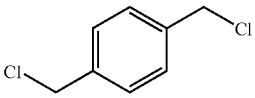 |
| Production Example 5 Exemplified compound No. 13 | 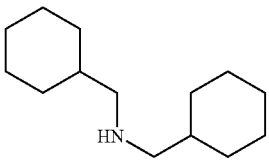 | 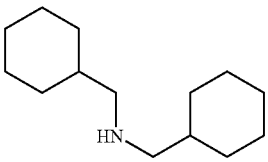 | 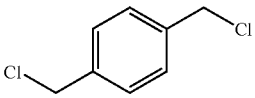 |
| Production Example 6 Exemplified compound No. 21 | 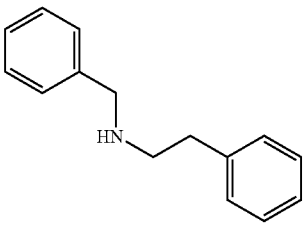 | 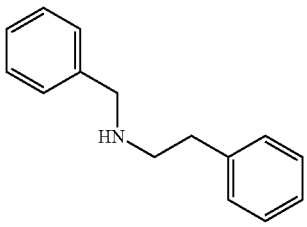 | 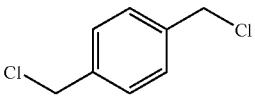 |
| Production Example 7 Exemplified compound No. 28 | 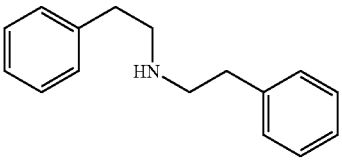 | 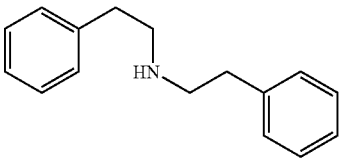 | 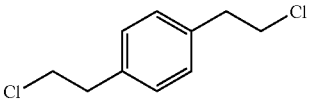 |

TABLE 3-1

| Compound | Structural formula |
|---|---|
| Production Example 1 Exemplified compound No 1 | 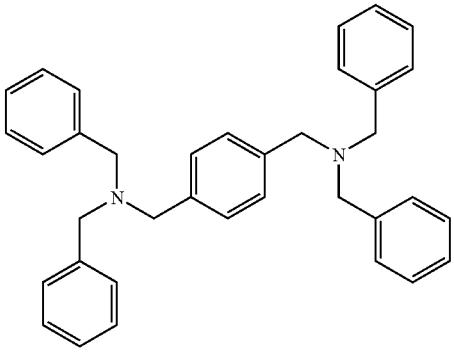 |

TABLE 3-1-continued
| Compound | Structural formula |
|---|---|
| Production Example 3 Exemplified compound No 3 | 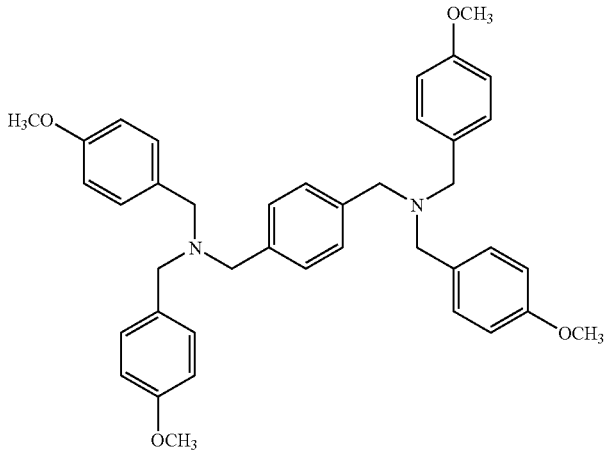 |
| Production Example 4 Exemplified compound No 7 | 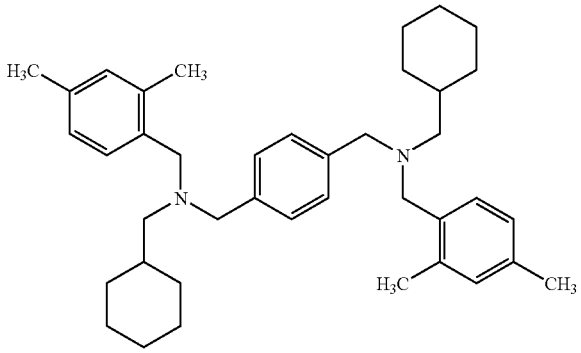 |
TABLE 3-2
| Compound | Structural formula |
|---|---|
| Production Example 5 Exemplified compound No 13 | 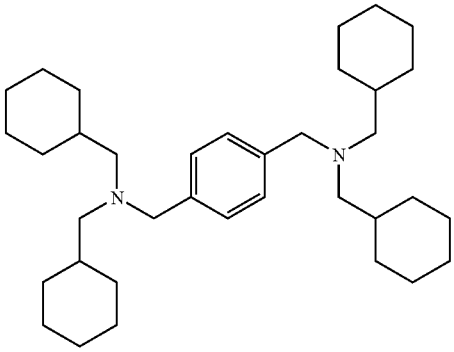 |

TABLE 3-2-continued

| Compound | Structural formula |
|---|---|
| Production Example 6 Exemplified compound No 21 | 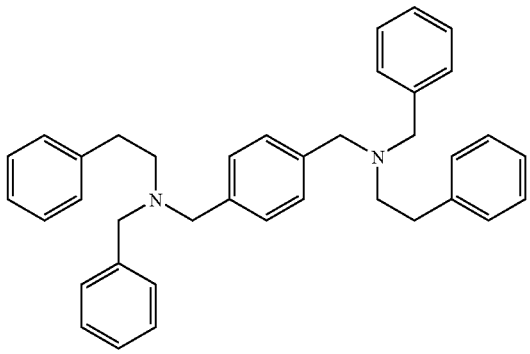 |
| Production Example 7 Exemplified compound No 28 | 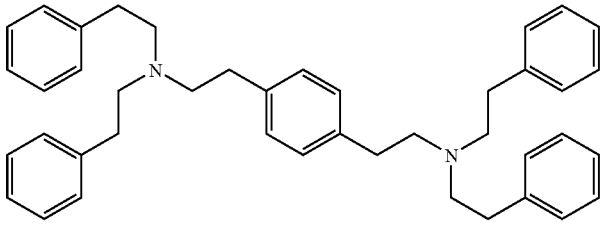 |

Example 1

A photoreceptor was produced in which the exemplified compound No. 1 which was the diamine compound produced in Production Example 1 according to the present invention was formulated in the surface protective layer.

As the conductive support, a cylindrical aluminum conductive support having an outer diameter of 30 mm and a length of 340 mm in its longitudinal direction was used.

0.3 parts by weight of titanium oxide (trade name: Taibake TTO55A, manufactured by Ishihara Sangyo Kaisha Ltd.), 0.3 parts by weight of an alcohol-soluble copolymer nylon resin (trade name: Amiran CM8000, manufactured by Toray Industries, Inc.), 4 parts by weight of methyl alcohol and 6 parts by weight of 1,3-dioxolan were subjected to dispersing treatment using a paint shaker for 10 hours to prepare an intermediate layer-forming coating solution. This intermediate layer-forming coating solution was applied to the cylindrical aluminum conductive support as the conductive support by the dip coating method to form an intermediate layer with a thickness of 1 μm.

Then, 1.5 parts by weight of titanylphthalocyanine represented by the following structural formula (3) (produced by the method described in, for example, the publication of JP No. 3569422), 1 part by weight of a polyvinylbutyral resin (trade name: Esrec BM-2, manufactured by Sekisui Chemical Co., Ltd.) and 140 parts by weight of 1,3-dioxolan as charge generation materials were subjected to dispersing treatment using a ball mill for 72 hours to prepare a charge generation layer-forming coating solution. This charge generation layer-forming coating solution was applied to a surface of the intermediate layer formed previously to form a charge generation layer with a film thickness of 0.1 μm.

(3)

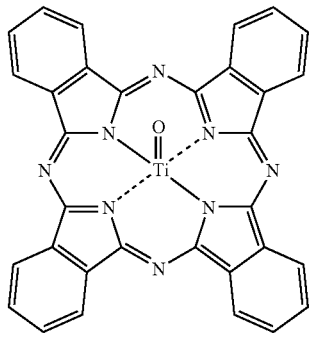

Then, 5 parts by weight of a butadiene type compound represented by the following structural formula (4) and 8.8 parts by weight of a polycarbonate resin (trade name: TS2050, manufactured by Teijin Chemicals Ltd.) were mixed and dissolved in 54 parts by weight of tetrahydrofuran to prepare a charge transport layer dispersion coating solution. This charge transport layer coating solution was applied to a surface of the above charge generation layer formed previously in the same manner as in the case of the above intermediate layer, to form a charge transport layer with a film thickness of 30 μm.

(4)

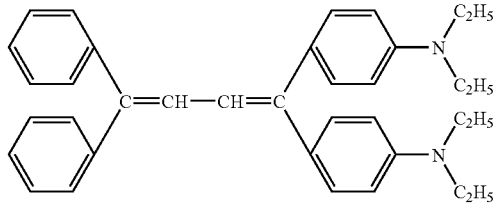

Then, 1 part by weight of silica particles (trade name: TS610, manufactured by Cabot Specialty Chemicals, average particle diameter: 17 nm) and 1 part by weight of a polycarbonate resin (trade name: Yuropyron Z800, manufactured by Mitsubishi Gas Chemical Industries) were mixed in 78 parts by weight of cyclohexanone. The mixture was subjected to dispersing treatment carried out by a ball mill using $ZrO_2$ beads (ϕ3 mm) as a media to prepare 3500 ml of a primary dispersion coating solution for a surface protective layer.

It was confirmed by a light-scattering type grain size distribution measuring device (trade name: Microtrack UPA-150, manufactured by Nikkiso Co., Ltd.) that the filler particles were uniformly dispersed in this stage and a dispersed state corresponding to the primary particle diameter (about 17 nm) was retained.

Then, 0.75 parts by weight of the exemplified compound No. 1 produced in Production Example 1 as the diamine compound and 29 parts by weight of a polycarbonate resin (trade name: Yuropyron Z800, manufactured by Mitsubishi Gas Chemical Industries) were mixed in 268 parts by weight of cyclohexanone. Then, this mixture was mixed with the primary dispersion coating solution for a surface protective layer and the mixture was stirred by a ball mill for 15 hours to prepare 4500 ml of a secondary dispersion coating solution for a surface protective layer. The secondary dispersion coating solution for a surface protective layer was applied to a surface of the charge transport layer formed previously in the same manner as in the case of the above intermediate layer to form a surface protective layer with a film thickness of 1 μm. A laminate type photoreceptor having a laminate structure in which the intermediate layer, charge generation layer, charge transport layer and surface protective layer were laminated in this order according to the present invention was thus produced as shown in FIG. 2.

Examples 2 to 4

Laminate type photoreceptors according to the present invention were produced in the same manner as in Example 1 except that the exemplified compounds No. 3, No. 7 and No. 13 were respectively used in place of the exemplified compound No. 1 produced in Production Example 1.

Examples 5 and 6

Laminate type photoreceptors according to the present invention were produced in the same manner as in Example 1 except that the amount of the exemplified compounds No. 1 produced in Production Example 1 was changed to 0.03 parts by weight and 6.00 parts by weight respectively from 0.75 parts by weight.

Example 7

A laminate type photoreceptor according to the present invention was produced in the same manner as in Example 1 except that 0.1 parts by weight of silica particles (trade name: TS-610, manufactured by Cabot Specialty Chemicals, average particle diameter: 17 nm) as the filler particles and 0.1 parts by weight of a polycarbonate resin (trade name: Yuropyron Z800, manufactured by Mitsubishi Gas Chemical Industries) were mixed in 135 parts by weight of cyclohexane and the mixture was subjected to dispersing treatment to prepare 3500 ml of a primary dispersion coating solution for a surface protective layer, and that 0.75 parts by weight of the exemplified compound No. 1 produced in Production Example 1 as the diamine compound and 29.9 parts by weight of a polycarbonate resin (trade name: Yuropyron Z800, manufactured by Mitsubishi Gas Chemicals Industries) were mixed in 276.9 parts by weight of cyclohexanone, the mixture was blended with the primary dispersion coating solution for a surface protective layer and the mixture was stirred by a ball mill for 15 hours to prepare 4500 ml of a secondary dispersion coating solution for a surface protective layer.

Example 8

A laminate type photoreceptor according to the present invention was produced in the same manner as in Example 1 except that 1 part by weight of silica particles (trade name: TS-610, manufactured by Cabot Specialty Chemicals, average particle diameter: 17 nm) as the filler particles and 1 part by weight of a polycarbonate resin (trade name: Yuropyron Z800, manufactured by Mitsubishi Gas Chemical Industries) were mixed in 198 parts by weight of cyclohexane and the mixture was subjected to dispersing treatment to prepare 3500 ml of a primary dispersion coating solution for a surface protective layer, and that 0.75 parts by weight of the exemplified compound No. 1 produced in Production Example 1 as the diamine compound and 29 parts by weight of a polycarbonate resin (trade name: Yuropyron Z800, manufactured by Mitsubishi Gas Chemicals Industries) were mixed in 268 parts by weight of cyclohexanone, the mixture was blended with the primary dispersion coating solution for a surface protective layer and the mixture was stirred by a ball mill for 15 hours to prepare 4500 ml of a secondary dispersion coating solution for a surface protective layer.

Example 9

A laminate type photoreceptor according to the present invention was produced in the same manner as in Example 1 except that 1 part by weight of silica particles (trade name: TS-610, manufactured by Cabot Specialty Chemicals, average particle diameter: 17 nm) as the filler particles and 1 part by weight of a polycarbonate resin (trade name: Yuropyron Z800, manufactured by Mitsubishi Gas Chemical Industries) were mixed in 52 parts by weight of cyclohexane and the mixture was subjected to dispersing treatment to prepare 3500 ml of a primary dispersion coating solution for a surface protective layer, and that 0.75 parts by weight of the exemplified compound No. 1 produced in Production Example 1 as the diamine compound and 29 parts by weight of a polycarbonate resin (trade name: Yuropyron Z800, manufactured by Mitsubishi Gas Chemicals Industries) were mixed in 268 parts by weight of cyclohexanone, the mixture was blended with the primary dispersion coating solution for a surface protective layer and the mixture was stirred by a ball mill for 15 hours to prepare 4500 ml of a secondary dispersion coating solution for a surface protective layer.

Example 10

A laminate type photoreceptor according to the present invention was produced in the same manner as in Example 1 except that alumina particles (trade name: Sumicorandom AA-04, manufactured by Sumitomo Chemical Co., Ltd., average particle diameter: 400 nm) was used as the filler particles in place of the silica particles (trade name: TS-610, manufactured by Cabot Specialty Chemicals, average particle diameter: 17 nm).

Example 11

A laminate type photoreceptor according to the present invention was produced in the same manner as in Example 1 except that silica particles (trade name: X-24-9163A, manufactured by Shin-Etsu Chemical Co., Ltd., average particle diameter: 100 nm) was used as the filler particles in place of the silica particles (trade name: TS-610, manufactured by Cabot Specialty Chemicals average particle diameter: 17 nm).

Example 12

A laminate type photoreceptor according to the present invention was produced in the same manner as in Example 1 except that silica particles (trade name: SO-E1, manufactured by Adomatics (K. K.), average particle diameter: 250 nm) was used as the filler particles in place of the silica particles (trade name: TS610, manufactured by Cabot Specialty Chemicals, average particle diameter: 17 nm).

Example 13

A laminate type photoreceptor according to the present invention was produced in the same manner as in Example 1 except that silica particles (trade name: SO-E5, manufactured by Adomatics (K. K.), average particle diameter: 1500 nm) was used as the filler particles in place of the silica particles (trade name: TS-610, manufactured by Cabot Specialty Chemicals, average particle diameter: 17 nm).

Comparative Example 1

A laminate type photoreceptor was produced in the same manner as in Example 1 except that 0.1 parts by weight of silica particles (trade name: TS-610, manufactured by Cabot Specialty Chemicals, average particle diameter: 17 nm) as the filler particles and 0.1 parts by weight of a polycarbonate resin (trade name: Yuropyron Z800, manufactured by Mitsubishi Gas Chemical Industries) were mixed in 199.8 parts by weight of cyclohexane and the mixture was subjected to dispersing treatment to prepare 3500 ml of a primary dispersion coating solution for a surface protective layer, and that 0.75 parts by weight of the exemplified compound No. 1 produced in Production Example 1 as the diamine compound and 29.9 parts by weight of a polycarbonate resin (trade name: Yuropyron Z800, manufactured by Mitsubishi Gas Chemicals Industries) were mixed in 276.9 parts by weight of cyclohexanone, the mixture was blended with the primary dispersion coating solution for a surface protective layer and the mixture was stirred by a ball mill for 15 hours to prepare 4500 ml of a secondary dispersion coating solution for a surface protective layer.

Comparative Example 2

A laminate type photoreceptor was produced in the same manner as in Example 1 except that 1 part by weight of silica particles (trade name: TS-610, manufactured by Cabot Specialty Chemicals, average particle diameter: 17 nm) as the filler particles and 1 part by weight of a polycarbonate resin (trade name: Yuropyron Z800, manufactured by Mitsubishi Gas Chemical Industries) were mixed in 48 parts by weight of cyclohexane and the mixture was subjected to dispersing treatment to prepare 3500 ml of a primary dispersion coating solution for a charge transport layer, and that 0.75 parts by weight of the exemplified compound No. 1 produced in Production Example 1 as the diamine compound and 1 part by weight of a polycarbonate resin (trade name: Yuropyron Z800, manufactured by Mitsubishi Gas Chemicals Industries) were mixed in 268 parts by weight of cyclohexanone, the mixture was blended with the primary dispersion coating solution for a surface protective layer and the mixture was stirred by a ball mill for 15 hours to prepare 4500 ml of a secondary dispersion coating solution for a surface protective layer.

Comparative Example 3

A laminate type photoreceptor was produced in the same manner as in Comparative Example 1 except that the exemplified compound No. 1 produced in Production Example 1 was not used as the diamine compound.

Comparative Example 4

A laminate type photoreceptor was produced in the same manner as in Comparative Example 2 except that the exemplified compound No. 1 produced in Production Example 1 was not used as the diamine compound.

Comparative Examples 5 and 6

Laminate type photoreceptors were produced in the same manner as in Example 1 except that the amount of the exemplified compounds No. 1 produced in Production Example 1 was changed to 0.0075 parts by weight and 9.00 parts by weight respectively from 0.75 parts by weight.

Comparative Example 7

A laminate type photoreceptor was produced in the same manner as in Example 1 except that an antioxidant (trade name: Irganox 1010, Ciba Specialty Chemicals Co., Ltd.) represented by the following structural formula (5) was used in place of the exemplified compound No. 1 produced in Production Example 1.

(5)

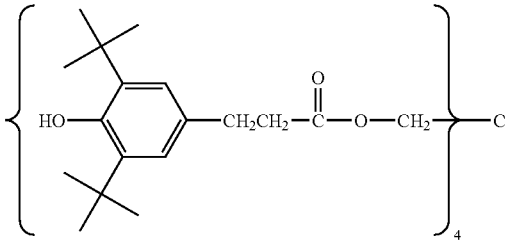

Comparative Example 8

A laminate type photoreceptor was produced in the same manner as in Example 1 except that an antioxidant represented by the following structural formula (6) was used in place of the exemplified compound No. 1 produced in Production Example 1.

(6)

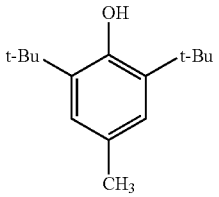

Comparative Example 9

A laminate type photoreceptor was produced in the same manner as in Example 1 except that a known antioxidant (trade name: TINUVIN 622, manufactured by Ciba-Geigy Corp., molecular weight: 3100 to 4000) represented by the following structural formula (7) was used in place of the exemplified compound No. 1 produced in Production Example 1.

(7)

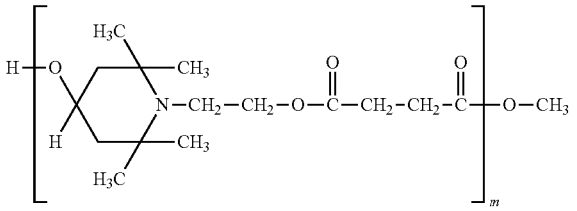

Comparative Example 10

A laminate type photoreceptor was produced in the same manner as in Example 1 except that a known antioxidant (manufactured by Tokyo Kasei Kogyo Co., Ltd.) represented by the following structural formula (8) was used in place of the exemplified compound No. 1 produced in Production Example 1.

(8)

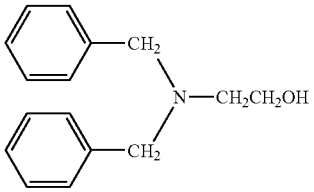

Comparative Example 11

A laminate type photoreceptor was produced in the same manner as in Example 1 except that a surface protective layer coating solution containing no filler particle was used.

Comparative Example 12

A laminate type photoreceptor was produced in the same manner as in Example 1 except that a surface protective layer coating solution containing neither a filler particle nor a diamine compound was used.

The following Examples 14 and Comparative Example 13 were carried out to evaluate the electric properties depending on the charging means.

Example 14

The same laminate type photoreceptor as that of Example 1 was produced to evaluate it by using a roller charger modified from the corona charger as the charging device.

Comparative Example 13

The same laminate type photoreceptor as that of Comparative Example 12 was produced to evaluate it by using a roller charger modified from the corona charger as the charging device.

Further, the following Examples 15 and Comparative Example 14 were carried out to evaluate printing durability to a magnetic toner of a mono component developer.

Example 15

The same laminate type photoreceptor as that of Example 1 was produced. A copying machine was remodeled for evaluation and the developing device was changed to that using a magnetic toner of a mono component developer to evaluate it.

Comparative Example 14

The same laminate type photoreceptor as that of Comparative Example 12 was produced. A copying machine was remodeled for evaluation and the developing device was changed to that using a magnetic toner of a mono component developer to evaluate it.

With respect to Examples 1 to 15 and Comparative Examples 1 to 12, the characteristics of the filler particles and additives to be used are shown in Table 4.

TABLE 4

| | Filler | | | | | | | |
|---|---|---|---|---|---|---|---|---|
| | Type | Composition | a | b | df | dm | Rf | Content |
| Example 1 | TS-610 | Silica | 73.5 | 17 | 1.5 | 1.1 | $1.69 \times 10-2$ | 1.25% |
| Example 2 | ↑ | ↑ | ↑ | ↑ | ↑ | ↑ | ↑ | ↑ |
| Example 3 | ↑ | ↑ | ↑ | ↑ | ↑ | ↑ | ↑ | ↑ |
| Example 4 | ↑ | ↑ | ↑ | ↑ | ↑ | ↑ | ↑ | ↑ |
| Example 5 | ↑ | ↑ | ↑ | ↑ | ↑ | ↑ | ↑ | ↑ |
| Example 6 | ↑ | ↑ | ↑ | ↑ | ↑ | ↑ | ↑ | ↑ |
| Example 7 | ↑ | ↑ | 188.6 | ↑ | ↑ | ↑ | $1.00 \times 10-3$ | 0.074% |
| Example 8 | ↑ | ↑ | 99.7 | ↑ | ↑ | ↑ | $6.76 \times 10^{-3}$ | 0.50% |
| Example 9 | ↑ | ↑ | 64.5 | ↑ | ↑ | ↑ | $2.50 \times 10^{-2}$ | 1.86% |
| Example 10 | AA-04 | Alumina | 2355 | 400 | 3.8 | ↑ | $1.69 \times 10-2$ | 1.25% |
| Example 11 | X-24 | Silica | 432 | 100 | 1.5 | 1.1 | ↑ | ↑ |
| Example 12 | SO-E1 | ↑ | 1080 | 250 | ↑ | ↑ | ↑ | ↑ |
| Example 13 | SO-E5 | ↑ | 6480 | 1500 | ↑ | ↑ | ↑ | ↑ |
| Example 14 | TS-610 | Silica | 73.5 | 17 | 1.5 | 1.1 | $1.69 \times 10-2$ | 1.25% |
| Example 15 | ↑ | ↑ | ↑ | ↑ | ↑ | ↑ | ↑ | ↑ |
| Comparative Example 1 | TS-610 | Silica | 214.9 | 17 | ↑ | ↑ | $6.75 \times 10^{-4}$ | 0.05% |
| Comparative Example 2 | ↑ | ↑ | 62.8 | ↑ | ↑ | ↑ | $2.70 \times 10^{-2}$ | 2.00% |
| Comparative Example 3 | ↑ | ↑ | 214.9 | ↑ | ↑ | ↑ | $6.75 \times 10^{-4}$ | 0.05% |
| Comparative Example 4 | ↑ | ↑ | 62.8 | ↑ | ↑ | ↑ | $2.70 \times 10^{-2}$ | 2.00% |
| Comparative Example 5 | ↑ | ↑ | 73.5 | ↑ | ↑ | ↑ | $1.69 \times 10^{-2}$ | 1.25% |
| Comparative Example 6 | ↑ | ↑ | ↑ | ↑ | ↑ | ↑ | ↑ | ↑ |

TABLE 4-continued

| | Filler | | | | | | | |
|---|---|---|---|---|---|---|---|---|
| | Type | Composition | a | b | df | dm | Rf | Content |
| Comparative Example 7 | ↑ | ↑ | ↑ | ↑ | ↑ | ↑ | ↑ | ↑ |
| Comparative Example 8 | ↑ | ↑ | ↑ | ↑ | ↑ | ↑ | ↑ | ↑ |
| Comparative Example 9 | ↑ | ↑ | ↑ | ↑ | ↑ | ↑ | ↑ | ↑ |
| Comparative Example 10 | ↑ | ↑ | ↑ | ↑ | ↑ | ↑ | ↑ | ↑ |
| Comparative Example 11 | | | | | | | | |
| Comparative Example 12 | | | | | | | | |

The photoreceptors produced in such a manner in Examples 1 to 15 and Comparative Examples 1 to 14 were subjected to tests to evaluate the sensitivity (electric properties), printing durability and image qualities and were overall rated based on these results.

(Evaluation of the Sensitivity (Electric Properties))

Specifically, each photoreceptor obtained in Examples 1 to 13 and Comparative Examples 1 to 12 was set to a digital copying machine (trade name: MX2300, manufactured by Sharp Corporation) remodeled for such a test use as to exchange the developing unit and surface potential measuring device, the copying machine being provided with a surface potentiometer (trade name: model 344, Treck Japan (k.k.) so as to be able to measure the surface potential in the course of image formation, to evaluate the sensitivity in the following manner by forming an image of the character test chart defined by ISO 19752 on 100000 sheets (100 k).

Using the above copying machine, the surface potential VL (V) of the photoreceptor was measured just after the photoreceptor was exposed by laser light under a low-temperature/low-humidity (L/L: Low Temperature/Low Humidity) environment at a temperature of 5° C. and a relative humidity of 20% and under a high-temperature/high-humidity (H/H: High Temperature/High Humidity) environment at a temperature of 35° C. and a humidity of 85%. Next, the surface potential after an image was printed on 100000 sheets by using the above copying machine was measured to detect a difference ΔVL in exposure potential from VL. It was evaluated that the smaller the ΔVL was, the better the stability of the sensitivity was.

<Criterion>

⊙: $|\Delta VL|<60V$

○: $60\ (V) \leqq |\Delta VL| < 70\ V$ x: $70\ (V) \leqq |\Delta VL|$ (Evaluation of the Printing Durability)

(a) Evaluation by Evaluation Device

The contact pressure of the cleaning blade of the cleaning unit installed in the above copying machine against the photoreceptor, that is the so-called cleaning blade pressure was adjusted to 21 gf/cm ($2.06\times10^{-1}$ N/cm: initial line pressure) in terms of initial line pressure. As to every photoreceptor, the above character test chart was formed on 100000 recording sheets under a normal temperature/normal-humidity (N/N: Normal Temperature/Normal Humidity) environment at a temperature of 25° C. and a humidity of 50% to measure a thickness of the photoreceptor after an image was formed on 100000 sheets by using a film thickness measuring device (trade name: F-20-EXR, manufactured by Filmetrix Company)

(b) Evaluation by Actual Machine

Each photoreceptor obtained in Examples 1 to 14 and Comparative Examples 1 to 13 and used for evaluation using actual machine was mounted on the above copying machine which was provided with a corona discharge device as the photoreceptor charging device and with a roller charger installed by remodeling. As to every photoreceptor, the above character test chart was formed on 100000 recording sheets under a normal-temperature/normal-humidity (N/N: Normal Temperature/Normal Humidity) environment at a temperature of 25° C. and a humidity of 50% to measure the thickness of the photoreceptor after an image was formed on 100000 sheets in the same manner as above.

The abrasive amount of the photoreceptor per 100000 rotations was found from the difference between the film thickness when the scratching test was started and the film thickness after an image was formed on 100000 sheets. The printing durability was evaluated from the obtained abrasive amount based on the following criterion. It was evaluated that the larger the abrasive amount was, the poorer the printing durability was.

<Evaluation Criteria>

⊙: Evaluating machine, Abrasive amount d<12 μm/100 k rotations

: Actual machine, Abrasive amount d<1.5 μm/100 k rotations

○: Evaluating machine, 1.2 μm/100 k rotations≦Abrasive amount d<1.5 μm/100 k rotations : Actual machine, 1.5 μm/100 k rotations≦Abrasive amount d<2.0 μm/100 k rotations x: Evaluating machine, 1.5 μm/100 k rotations≦Abrasive amount d : Actual machine, 2.0 μm/100 k rotations≦Abrasive amount d (Ozone Gas Resistance)

(a) Evaluation by Evaluation Device

Each photoreceptor (layer thickness of the charge transport layer: 15 μm) obtained in Examples 1 to 15 and Comparative Examples 1 to 14 and used for evaluation using actual machine was mounted on the above copying machine in which a surface potentiometer (trade name: CATE751, manufactured by Genetech Company) was installed in the above copying machine so as to enable the measurement of the surface potential of the photoreceptor in the course of image formation. The surface potential of the photoreceptor was measured under a high-temperature/high-humidity (H/H: High Temperature/High Humidity) environment at a temperature of 35° C. and a humidity of 85% 0 second, 2 seconds and 5 seconds after the photoreceptor was charged before exposed to ozone to calculate the charge retention rates of the photoreceptors obtained after charged for 2 seconds and 5 seconds respectively.

Then, using an ozone generation and control device (trade name: OES-10A, manufactured by Dairec Company), the photoreceptor was exposed to ozone in a sealed container adjusted to an ozone concentration of about 5.0 ppm (confirmed by an ozonometer (trade name: MODEL 1200, manufactured by Dairec Company)) for 20 hours to calculate the charge retention rates of the photoreceptors obtained after charged for 2 seconds and 5 seconds respectively in the same method as above. Here, the ozone gas resistance was evaluated by a difference ΔDD between the charge retention rates before and after the photoreceptor was exposed to ozone.

(b) Evaluation by Actual Machine

Each photoreceptor (layer thickness of the charge transport layer: 28 μm) obtained in Examples 1 to 15 and Comparative Examples 1 to 14 and used for evaluation using actual machine was mounted on the above copying machine which was provided with a corona discharge device as the photoreceptor charging device and with a roller charger installed by remodeling. As to every photoreceptor, a specified pattern test image was actually printed on 100000 recording sheets under a high-temperature/high-humidity (H/H) environment at a temperature of 35° C. and a humidity of 85%.

With regard to Example 15 and Comparative Example 14, the evaluation of the printing durability was made using a magnetic toner of a mono component developer.

After the operation of the copying machine was suspended for one hour since the actual printing of 100000 sheets was finished, a half-tone image was copied on a recording sheet which was adopted as a first evaluation image. Then, a specified pattern test image was actually printed on 100000 recording sheets under a high-temperature/high-humidity (H/H) environment at a temperature of 35° C. and a humidity of 85%. After the operation of the copying machine was suspended for one hour since the actual printing of 100000 sheets was finished, a half-tone image was copied on a recording sheet which was adopted as a second evaluation image.

The formed first evaluation image and second evaluation image were each observed visually to rate image qualities at the portion of the recording sheet corresponding to the portion where a toner image was transferred from the portion of the photoreceptor disposed near to the charger when the operation of the copying machine was suspended by the degree of the generation of image defects such as white voids and black bands, and the rated image qualities were defined as the evaluation index of the ozone gas resistance. The criterion of the image quality is as follows.

<Evaluation Criteria>

Excellent: No image defect is generated at all in both of the first and second evaluation images.

Good: Though some image defects are generated in any one or both of the first and second evaluation images, the level of this image defects is negligible.

Not acceptable: Some image defects are generated in both of the first and second evaluation images.

The above charge retention rate ΔDD and the result of the rating of image qualities were combined to evaluate the ozone resistance of the photoreceptor. The evaluation standard of the ozone gas resistance is as follows.

⊙: ΔDD is less than 5.0% and image quality is excellent (⊙).

○: ΔDD is 5.0% or more and less than 10.0% and image quality is excellent (⊙), or ΔDD is less than 10.0% and image quality is good (○).

x: ΔDD is 10.0% or more or the image quality is not acceptable (x).

(Overall Evaluation)

From the above results of decisions of the five items, the overall evaluation of the photoreceptor was made based on the following criterion.

⊙: The results of the four items are all "○" or higher.

○: At least one item is "○" or higher.

x: At least one item is "x".

The results of the evaluation of Examples 1 to 15 and Comparative Example 1 to 14 were evaluated according to the above evaluation methods. The results are shown in BBB shown below.

TABLE 5

| | Additive | | | | Abrasive amount μm/100000 rotations | | Scratching | Ozone resistance H/H environment | | |
|---|---|---|---|---|---|---|---|---|---|---|
| | Exemplified compound No. | J/B | Charging means | Developing means | Evaluating device | Actual machine | resistance evaluation | ΔDD | Image qualities | Evaluation |
| Example 1 | 1 | 2.50% | Corona | Two-component | 0.85 | 1.08 | ⊙ | 1.5 | Excellent | ⊙ |
| Example 2 | 3 | ↑ | ↑ | Two-component | 0.82 | 1.07 | ⊙ | 3.2 | Excellent | ⊙ |
| Example 3 | 7 | ↑ | ↑ | Two-component | 0.85 | 1.10 | ⊙ | 2.6 | Excellent | ⊙ |
| Example 4 | 13 | ↑ | ↑ | Two-component | 0.80 | 1.01 | ⊙ | 3 | Excellent | ⊙ |
| Example 5 | 1 | 0.10% | ↑ | Two-component | 0.90 | 1.26 | ⊙ | 4.8 | Excellent | ⊙ |
| Example 6 | 1 | 20% | ↑ | Two-component | 0.97 | 1.30 | ⊙ | 2.6 | Excellent | ⊙ |
| Example 7 | 1 | 2.50% | ↑ | Two-component | 0.99 | 1.30 | ⊙ | 1.9 | Excellent | ⊙ |
| Example 8 | ↑ | ↑ | ↑ | Two-component | 0.90 | 1.27 | ⊙ | 1.8 | Excellent | ⊙ |
| Example 9 | ↑ | ↑ | ↑ | Two-component | 0.74 | 1.01 | ⊙ | 2.1 | Excellent | ⊙ |
| Example 10 | ↑ | ↑ | ↑ | Two-component | 1.10 | 1.43 | ⊙ | 2.5 | Excellent | ⊙ |
| Example 11 | ↑ | ↑ | ↑ | Two-component | 0.91 | 1.22 | ⊙ | 2.1 | Excellent | ⊙ |
| Example 12 | ↑ | ↑ | ↑ | Two-component | 0.88 | 1.25 | ⊙ | 2 | Excellent | ⊙ |
| Example 13 | ↑ | ↑ | ↑ | Two-component | 0.98 | 1.28 | ⊙ | 2 | Excellent | ⊙ |
| Example 14 | ↑ | ↑ | Roller | Two-component | 1.14 | 1.40 | ⊙ | — | Excellent | ⊙ |
| Example 15 | ↑ | ↑ | Corona | One-component | — | 1.45 | ⊙ | — | Excellent | ⊙ |
| Comparative Example 1 | ↑ | ↑ | Corona | Two-component | 1.75 | 2.02 | X | 2.4 | Excellent | ⊙ |
| Comparative Example 2 | ↑ | ↑ | ↑ | Two-component | 0.90 | 1.24 | ⊙ | 2.1 | Good | ○ |
| Comparative Example 3 | | | ↑ | Two-component | 1.92 | 2.35 | X | 13.3 | Not acceptable | X |
| Comparative Example 4 | | | ↑ | Two-component | 1.03 | 1.33 | ⊙ | 11.5 | CCC | X |
| Comparative Example 5 | 1 | 0.025% | ↑ | Two-component | 0.80 | 1.00 | ⊙ | 9.8 | Good | ○ |
| Comparative Example 6 | ↑ | 30% | ↑ | Two-component | 1.30 | 1.78 | ○ | 1.6 | Excellent | ⊙ |
| Comparative Example 7 | | | ↑ | Two-component | 1.25 | 1.56 | ○ | 15.7 | Not acceptable | X |
| Comparative Example 8 | | | ↑ | Two-component | 1.51 | 1.84 | ○ | 19.7 | Not acceptable | X |
| Comparative Example 9 | | | ↑ | Two-component | 1.14 | 1.45 | ⊙ | 13.1 | Not acceptable | ○ |
| Comparative Example 10 | | | ↑ | Two-component | 1.12 | 1.44 | ⊙ | 16.5 | Not acceptable | ○ |
| Comparative Example 11 | 1 | 2.50% | ↑ | Two-component | 2.10 | 2.86 | X | 2.6 | Excellent | ⊙ |
| Comparative Example 12 | | | ↑ | Two-component | 2.20 | 2.89 | X | 16.5 | Not acceptable | X |
| Comparative Example 13 | | | Roller | Two-component | 3.70 | 3.42 | X | — | Not acceptable | X |
| Comparative Example 14 | | | Corona | One-component | — | 3.33 | X | — | Not acceptable | X |

TABLE 5-continued

| | Exposure potential (V) | | | | | | |
|---|---|---|---|---|---|---|---|
| | L/L environment | | | H/H environment | | | Overall |
| | VL | ΔVL | Evaluation | VL | ΔVL | Evaluation | evaluation |
| Example 1 | −146 | −24 | ◎ | −72 | −52 | ◎ | ◎ |
| Example 2 | −151 | −29 | ◎ | −72 | −55 | ◎ | ◎ |
| Example 3 | −155 | −33 | ◎ | −78 | −57 | ◎ | ◎ |
| Example 4 | −160 | −42 | ◎ | −80 | −56 | ◎ | ◎ |
| Example 5 | −161 | −44 | ◎ | −69 | −48 | ◎ | ◎ |
| Example 6 | −170 | −58 | ◎ | −66 | −48 | ◎ | ◎ |
| Example 7 | −152 | −32 | ◎ | −77 | −55 | ◎ | ◎ |
| Example 8 | −187 | −67 | ○ | −82 | −84 | ○ | ○ |
| Example 9 | −150 | −32 | ◎ | −77 | −53 | ◎ | ◎ |
| Example 10 | −189 | −68 | ○ | −71 | −50 | ◎ | ○ |
| Example 11 | −162 | −44 | ◎ | −70 | −52 | ◎ | ◎ |
| Example 12 | −177 | −57 | ○ | −85 | −63 | ○ | ○ |
| Example 13 | −182 | −63 | ○ | −82 | −60 | ◎ | ○ |
| Example 14 | — | — | ◎ | — | — | ◎ | ◎ |
| Example 15 | — | — | ◎ | — | — | ◎ | ○ |
| Comparative Example 1 | −144 | −23 | ◎ | −66 | −47 | ◎ | X |
| Comparative Example 2 | −196 | −75 | X | −102 | −78 | X | X |
| Comparative Example 3 | −138 | −21 | ◎ | −66 | −46 | ◎ | X |
| Comparative Example 4 | −182 | −66 | ○ | −90 | −69 | ○ | X |
| Comparative Example 5 | −162 | −45 | ◎ | −84 | −64 | ○ | X |
| Comparative Example 6 | −191 | −71 | X | −88 | −68 | ○ | X |
| Comparative Example 7 | −157 | −40 | ◎ | −77 | −56 | ◎ | X |
| Comparative Example 8 | −143 | −28 | ◎ | −73 | −58 | ◎ | X |
| Comparative Example 9 | −205 | −80 | X | −105 | −80 | X | X |
| Comparative Example 10 | −210 | −82 | X | −110 | −84 | X | X |
| Comparative Example 11 | −142 | −22 | ◎ | −62 | −44 | ◎ | X |
| Comparative Example 12 | −148 | −28 | ◎ | −61 | −42 | ◎ | X |
| Comparative Example 13 | — | — | ◎ | — | — | ◎ | X |
| Comparative Example 14 | — | — | ◎ | — | — | ◎ | X |

When comparing the photoreceptors of Examples 1 to 13 containing filler particles in the surface protective layer in such a dispersed state as to satisfy the requirement of the equation (1) with the photoreceptors of Comparative Examples 1 to 13 containing filler particles in the charge transport layer in such a dispersed state as not to satisfy the requirement of the equation (1), it is found that the abrasive amount when 100000 sheets were actually printed was 1.2 μm or less, exhibiting higher printing durability and the electric stability was at a practically unproblematic level. It is also found that the photoreceptors of Comparative Examples 1 to 4 fail to obtain a desired sensitivity/stability or abrasive amount of the film.

It is found from the comparison between Examples 1 to 4 and Comparative Examples 3 to 6 that the photoreceptors containing a diamine compound according to the present invention are reduced in film abrasion, are superior in gas resistance and have better stability of electric properties.

Also, it is found that the exemplified compound No. 1 is most superior in gas resistance and is particularly useful.

It is also found from the comparison between Example 1 and Comparative Examples 5 and 6 that the photoreceptor of the present invention in which the ratio J/B of the weight J of the diamine compound according to the present invention to the weight B of the binder resin is 0.1/100 or more and 20/100 or less is more reduced in the abrasion of the film, is superior in gas resistance and has better stability of electric properties.

It is found from the comparison between the exposure potentials of Examples 1, 11 to 13 and an exposure potential of Example 10 that silica is superior in electric resistance to alumina.

It is also found from the comparison between Examples 1 and 13 to 15 to Example 12 that the electric properties of the photoreceptors having filler particles having a smaller particle diameter are more stabilized and the particle diameter of silica to be added is preferably 100 nm or less.

It is also found from the comparison between Examples 1 and 14 and Comparative Examples 12 and 13 that the photoreceptor of the present invention is superior in scratch resistance even in the case of using roller charging as the charging device, showing that it is effective also in the contact type charging system.

It is also found from the comparison between Examples 1 and 15 and Comparative Examples 12 and 14 that the photoreceptor of the present invention is superior in scratch resistance even in the case of using a developer having a higher hardness.

As mentioned above, a highly durable photoreceptor can be obtained which is superior in mechanical/electrical durability even in long-term repeated use and can output a stable image over a long period of time without forming abnormal images such as blurred images by compounding specified filler particles and a specified diamine compound in the surface protective layer formed on the upper part of the charge transport layer.

INDUSTRIAL APPLICABILITY

According to the present invention, specified filler particles and a specified diamine compound are formulated in the surface protective layer formed on the upper part of the charge transport layer, which makes it possible to provide a highly durable photoreceptor which is superior in mechanical/electrical durability even in long-term repeated use and can output a stable image over a long period of time without forming abnormal images such as blurred images and also to provide an image formation device provided with the photoreceptor.

What is claimed is:

1. An electrophotographic photoreceptor comprising a conductive support and a photosensitive layer obtained by laminating at least a charge generation layer and a charge transport layer containing a charge transport material in this order on the conductive support, the photosensitive layer being provided with a surface protective layer on the surface thereof, wherein the protective layer contains at least filler particles which exhibit a dispersed state defined by Rf given by the following equations (1) and (2):

$$Rf=(df\times b^3)/(dm\times a^3) \quad (1)$$

$$1.0\times10^{-3}\leqq Rf\leqq 2.5\times10^{-2} \quad (2)$$

wherein a is an average distance (nm) between fillers, b is an average particle diameter (nm) of fillers, df is a density ($g/cm^3$) of filler particles and dm is an average density ($g/cm^3$) of a solid in the surface protective layer, and a diamine compound represented by the following formula (I):

(I)

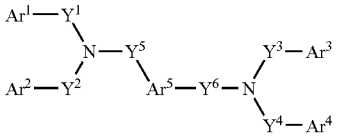

wherein $Ar^1$, $Ar^2$, $Ar^3$ and $Ar^4$, which may be the same or different, each represent an aryl group, cycloalkyl group or monovalent heterocyclic residue which may have a substituent; $Ar^5$ represents an arylene group or a divalent heterocyclic residue; and $Y^1$, $Y^2$, $Y^3$, $Y^4$, $Y^5$ and $Y^6$, which may be the same or different, each represent a chain alkylene group which may have a substituent.

2. The electrophotographic photoreceptor according to claim 1, wherein the diamine compound is represented by the following sub-formula (II):

(II)

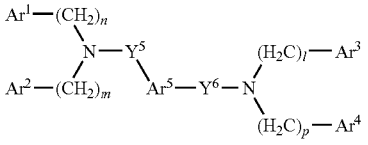

wherein $Ar^1$, $Ar^2$, $Ar^3$, $Ar^4$, $Ar^5$, $Y^5$ and $Y^6$ each represent the same meanings as those in the above formula (I); and l, m, n and p, which may be the same or different, each denote an integer from 1 to 3.

3. The electrophotographic photoreceptor according to claim 1, wherein the diamine compound is represented by the following sub-formula (III):

(III)

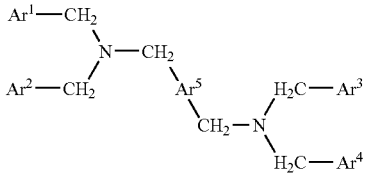

wherein $Ar^1$, $Ar^2$, $Ar^3$, $Ar^4$ and $Ar^5$ each represent have the same meanings as those in the above formula (I).

4. The electrophotographic photoreceptor according to claim 1, wherein the diamine compound is comprised in a ratio by weight of 0.1/100 to 20/100 based on a binder resin forming the surface protective layer.

5. The electrophotographic photoreceptor according to claim 1, wherein the filler particles are made of silicon oxide.

6. The electrophotographic photoreceptor according to claim 1, wherein the filler particles each have an average particle diameter of 100 nm or less.

7. The electrophotographic photoreceptor according to claim 1, further comprising an intermediate layer between the conductive support and the laminated-type photosensitive layer.

8. An image formation device comprising the electrophotographic photoreceptor according to claim 1, a charging means that charges the photoreceptor, an exposure means that exposes the above charged photoreceptor to light to form an electrostatic latent image, a developing means that develops the electrostatic latent image formed by the exposure and a transfer means that transfers the above electrostatic latent image to a transfer material.

9. The image formation device according to claim 8, wherein the charging means is a contact charging system which uses a roller.

10. The image formation device according to claim 8, wherein the developing means is a mono component magnetic developing system.

* * * * *